US010092819B2

(12) United States Patent
Haushalter et al.

(10) Patent No.: US 10,092,819 B2
(45) **Date of Patent: *Oct. 9, 2018**

(54) PLAYING CARD HANDLING DEVICES, SYSTEMS, AND METHODS FOR VERIFYING SETS OF CARDS

(71) Applicant: Bally Gaming, Inc., Las Vegas, NV (US)

(72) Inventors: Todd M. Haushalter, Las Vegas, NV (US); Nathan J. Wadds, Waverley (AU)

(73) Assignee: Bally Gaming, Inc., Las Vegas, NV (US)

( * ) Notice: Subject to any disclaimer, the term of this patent is extended or adjusted under 35 U.S.C. 154(b) by 44 days.

This patent is subject to a terminal disclaimer.

(21) Appl. No.: 15/332,918

(22) Filed: Oct. 24, 2016

(65) Prior Publication Data

US 2017/0036098 A1 Feb. 9, 2017

Related U.S. Application Data

(63) Continuation of application No. 14/279,161, filed on May 15, 2014, now Pat. No. 9,474,957.

(51) Int. Cl.

| | |
|---|---|
| ***A63F 1/12*** | (2006.01) |
| ***A63F 1/14*** | (2006.01) |
| *A63F 3/06* | (2006.01) |

(52) U.S. Cl.

CPC ..... *A63F 1/12* (2013.01); *A63F 1/14* (2013.01); *A63F 2003/066* (2013.01); *A63F 2250/58* (2013.01)

(58) Field of Classification Search

CPC ..... A63F 1/12; A63F 1/14; A63F 2003/066; A63F 2003/58; A63F 2250/58

(Continued)

(56) References Cited

U.S. PATENT DOCUMENTS

| | | | |
|---|---|---|---|
| 130,281 | A | 8/1872 | Coughlin |
| 205,030 | A | 6/1878 | Ash |

(Continued)

FOREIGN PATENT DOCUMENTS

| | | | |
|---|---|---|---|
| AU | 2383667 | A | 1/1969 |
| AU | 5025479 | A1 | 3/1980 |

(Continued)

OTHER PUBLICATIONS

⅓" B/W CCD Camera Module EB100 by EverFocus Electronics Corp., Jul. 31, 2001, 3 pgs.

(Continued)

*Primary Examiner* — Benjamin Layno
(74) *Attorney, Agent, or Firm* — TraskBritt

(57) ABSTRACT

Systems include an automatic card shuffler and a shoe. The automatic card shuffler may include a printing device for applying a randomly selected set symbol on each card of a set of cards. The shoe may include a set symbol reader for reading each card for a presence and identity of a set symbol. A shoe processor may be configured to receive a signal from a shuffler processor indicating the selected set symbol to enable the shoe processor to verify that each card belongs to the set of cards. An automatic card shuffler includes a processor programmed to randomly select a card set symbol and a card-marking system for forming the randomly selected set symbol on cards. Methods include forming a randomly determined set symbol on each card of a set of cards and detecting whether cards include a set symbol matching the determined set symbol.

20 Claims, 6 Drawing Sheets

(58) Field of Classification Search
USPC ..... 273/149 R, 149 P; 463/22, 29
See application file for complete search history.

(56) References Cited

U.S. PATENT DOCUMENTS

| | | | |
|---|---|---|---|
| 609,730 | A | 8/1898 | Booth |
| 673,154 | A | 4/1901 | Bellows |
| 793,489 | A | 6/1905 | Williams |
| 892,389 | A | 7/1908 | Bellows |
| 1,014,219 | A | 1/1912 | Hall |
| 1,043,109 | A | 11/1912 | Hurm |
| 1,157,898 | A | 10/1915 | Perret |
| 1,992,085 | A | 2/1925 | McKay |
| 1,556,856 | A | 10/1925 | Lipps |
| 1,850,114 | A | 6/1929 | McCaddin |
| 1,757,553 | A | 5/1930 | Gustav |
| 1,885,276 | A | 11/1932 | McKay |
| 1,889,729 | A | 11/1932 | Hammond |
| 1,955,926 | A | 4/1934 | Matthaey |
| 1,998,690 | A | 4/1935 | Shepherd et al. |
| 2,001,220 | A | 5/1935 | Smith |
| 2,001,918 | A | 5/1935 | Nevius |
| 2,016,030 | A | 10/1935 | Woodruff et al. |
| 2,043,343 | A | 6/1936 | Warner |
| 2,060,096 | A | 11/1936 | McCoy |
| 2,065,824 | A | 12/1936 | Plass |
| 2,159,958 | A | 5/1939 | Sachs |
| 2,185,474 | A | 1/1940 | Nott |
| 2,254,484 | A | 9/1941 | Hutchins |
| D132,360 | S | 5/1942 | Gardner |
| 2,328,153 | A | 8/1943 | Laing |
| 2,328,879 | A | 9/1943 | Isaacson |
| D139,530 | S | 11/1944 | Schindler |
| 2,364,413 | A | 12/1944 | Wittel |
| 2,525,305 | A | 10/1950 | Lombard |
| 2,543,522 | A | 2/1951 | Cohen |
| 2,588,582 | A | 3/1952 | Sivertson |
| 2,615,719 | A | 10/1952 | Foken |
| 2,659,607 | A | 11/1953 | Skillman et al. |
| 2,661,215 | A | 12/1953 | Stevens |
| 2,676,020 | A | 4/1954 | Ogden |
| 2,692,777 | A | 10/1954 | Miller |
| 2,701,720 | A | 2/1955 | Ogden |
| 2,705,638 | A | 4/1955 | Newcomb |
| 2,711,319 | A | 6/1955 | Morgan et al. |
| 2,714,510 | A | 8/1955 | Oppenlander et al. |
| 2,717,782 | A | 9/1955 | Droll |
| 2,727,747 | A | 12/1955 | Semisch, Jr. |
| 2,731,271 | A | 1/1956 | Brown |
| 2,747,877 | A | 5/1956 | Howard |
| 2,755,090 | A | 7/1956 | Aldrich |
| 2,757,005 | A | 7/1956 | Nothaft |
| 2,760,779 | A | 8/1956 | Ogden et al. |
| 2,770,459 | A | 11/1956 | Wilson et al. |
| 2,778,643 | A | 1/1957 | Williams |
| 2,778,644 | A | 1/1957 | Stephenson |
| 2,782,040 | A | 2/1957 | Matter |
| 2,790,641 | A | 4/1957 | Adams |
| 2,793,863 | A | 5/1957 | Liebelt |
| 2,815,214 | A | 12/1957 | Hall |
| 2,821,399 | A | 1/1958 | Heinoo |
| 2,914,215 | A | 11/1959 | Neidig |
| 2,937,739 | A | 5/1960 | Levy |
| 2,950,005 | A | 8/1960 | MacDonald |
| RE24,986 | E | 5/1961 | Stephenson |
| 3,067,885 | A | 12/1962 | Kohler |
| 3,107,096 | A | 10/1963 | Osborn |
| 3,124,674 | A | 3/1964 | Edwards et al. |
| 3,131,935 | A | 5/1964 | Gronneberg |
| 3,147,978 | A | 9/1964 | Sjostrand |
| D200,652 | S | 3/1965 | Fisk |
| 3,222,071 | A | 12/1965 | Lang |
| 3,235,741 | A | 2/1966 | Plaisance |
| 3,288,308 | A | 11/1966 | Gingher |
| 3,305,237 | A | 2/1967 | Granius |
| 3,312,473 | A | 4/1967 | Friedman et al. |
| 3,452,509 | A | 7/1969 | Hauer |
| 3,530,968 | A | 9/1970 | Palmer |
| 3,588,116 | A | 6/1971 | Miura |
| 3,589,730 | A | 6/1971 | Slay |
| 3,595,388 | A | 7/1971 | Castaldi |
| 3,597,076 | A | 8/1971 | Hubbard et al. |
| 3,618,933 | A | 11/1971 | Roggenstein et al. |
| 3,627,331 | A | 12/1971 | Erickson |
| 3,666,270 | A | 5/1972 | Mazur |
| 3,680,853 | A | 8/1972 | Houghton et al. |
| 3,690,670 | A | 9/1972 | Cassady et al. |
| 3,704,938 | A | 12/1972 | Fanselow |
| 3,716,238 | A | 2/1973 | Porter |
| 3,751,041 | A | 8/1973 | Seifert |
| 3,761,079 | A | 9/1973 | Azure, Jr. |
| 3,810,627 | A | 5/1974 | Levy |
| D232,953 | S | 9/1974 | Oguchi |
| 3,861,261 | A | 1/1975 | Maxey |
| 3,897,954 | A | 8/1975 | Erickson et al. |
| 3,899,178 | A | 8/1975 | Watanabe |
| 3,909,002 | A | 9/1975 | Levy |
| 3,929,339 | A | 12/1975 | Mattioli |
| 3,944,077 | A | 3/1976 | Green |
| 3,944,230 | A | 3/1976 | Fineman |
| 3,949,219 | A | 4/1976 | Crouse |
| 3,968,364 | A | 7/1976 | Miller |
| 4,023,705 | A | 5/1977 | Reiner et al. |
| 4,033,590 | A | 7/1977 | Pic |
| 4,072,930 | A | 2/1978 | Lucero et al. |
| 4,088,265 | A | 5/1978 | Garczynski |
| 4,151,410 | A | 4/1979 | McMillan et al. |
| 4,159,581 | A | 7/1979 | Lichtenberg |
| 4,162,649 | A | 7/1979 | Thornton |
| 4,166,615 | A | 9/1979 | Noguchi et al. |
| 4,232,861 | A | 11/1980 | Maul |
| 4,280,690 | A | 7/1981 | Hill |
| 4,283,709 | A | 8/1981 | Lucero et al. |
| 4,310,160 | A | 1/1982 | Willette et al. |
| 4,339,134 | A | 7/1982 | Macheel |
| 4,339,798 | A | 7/1982 | Hedges et al. |
| 4,361,393 | A | 11/1982 | Noto |
| 4,368,972 | A | 1/1983 | Naramore |
| 4,369,972 | A | 1/1983 | Parker |
| 4,374,309 | A | 2/1983 | Walton |
| 4,377,285 | A | 3/1983 | Kadlic |
| 4,385,827 | A | 5/1983 | Naramore |
| 4,388,994 | A | 6/1983 | Suda et al. |
| 4,397,469 | A | 8/1983 | Carter, III |
| 4,421,312 | A | 12/1983 | Delgado et al. |
| 4,421,501 | A | 12/1983 | Scheffer |
| D273,962 | S | 5/1984 | Fromm |
| D274,069 | S | 5/1984 | Fromm |
| 4,467,424 | A | 8/1984 | Hedges et al. |
| 4,494,197 | A | 1/1985 | Troy et al. |
| 4,497,488 | A | 2/1985 | Plevyak et al. |
| 4,512,580 | A | 4/1985 | Matviak |
| 4,513,969 | A | 4/1985 | Samsel, Jr. |
| 4,515,367 | A | 5/1985 | Howard |
| 4,531,187 | A | 7/1985 | Uhland |
| 4,534,562 | A | 8/1985 | Cuff et al. |
| 4,549,738 | A | 10/1985 | Greitzer |
| 4,566,782 | A | 1/1986 | Britt et al. |
| 4,575,367 | A | 3/1986 | Karmel |
| 4,586,712 | A | 5/1986 | Lorber et al. |
| 4,659,082 | A | 4/1987 | Greenberg |
| 4,662,637 | A | 5/1987 | Pfeiffer |
| 4,662,816 | A | 5/1987 | Fabrig |
| 4,667,959 | A | 5/1987 | Pfeiffer et al. |
| 4,741,524 | A | 5/1988 | Bromage |
| 4,750,743 | A | 6/1988 | Nicoletti |
| 4,755,941 | A | 7/1988 | Bacchi |
| 4,759,448 | A | 7/1988 | Kawabata |
| 4,770,412 | A | 9/1988 | Wolfe |
| 4,770,421 | A | 9/1988 | Hoffman |
| 4,807,884 | A | 2/1989 | Breeding |
| 4,822,050 | A | 4/1989 | Normand et al. |
| 4,832,342 | A | 5/1989 | Plevyak et al. |
| 4,858,000 | A | 8/1989 | Lu |

(56) References Cited

U.S. PATENT DOCUMENTS 4,861,041 A 8/1989 Jones et al.
4,876,000 A 10/1989 Mikhail
4,900,009 A 2/1990 Kitahara et al.
4,904,830 A 2/1990 Rizzuto
4,921,109 A 5/1990 Hasuo et al.
4,926,327 A 5/1990 Sidley
4,948,134 A 8/1990 Suttle et al.
4,951,950 A 8/1990 Normand et al.
4,969,648 A 11/1990 Hollinger et al.
4,993,587 A 2/1991 Abe
4,995,615 A 2/1991 Cheng
5,000,453 A 3/1991 Stevens et al.
5,039,102 A 8/1991 Miller
5,067,713 A 11/1991 Soules et al.
5,078,405 A 1/1992 Jones et al.
5,081,487 A 1/1992 Hoyer et al.
5,096,197 A 3/1992 Embury
5,102,293 A 4/1992 Schneider
5,118,114 A 6/1992 Tucci
5,121,192 A 6/1992 Kazui
5,121,921 A 6/1992 Friedman et al.
5,146,346 A 9/1992 Knoll
5,154,429 A 10/1992 LeVasseur
5,179,517 A 1/1993 Sarbin et al.
5,197,094 A 3/1993 Tillery et al.
5,199,710 A 4/1993 Lamle
5,209,476 A 5/1993 Eiba
5,224,712 A 7/1993 Laughlin et al.
5,240,140 A 8/1993 Huen
5,248,142 A 9/1993 Breeding
5,257,179 A 10/1993 DeMar
5,259,907 A 11/1993 Soules et al.
5,261,667 A 11/1993 Breeding
5,267,248 A 11/1993 Reyner
5,275,411 A 1/1994 Breeding
5,276,312 A 1/1994 McCarthy
5,283,422 A 2/1994 Storch et al.
5,288,081 A 2/1994 Breeding
5,299,089 A 3/1994 Lwee
5,303,921 A 4/1994 Breeding
5,344,146 A 9/1994 Lee
5,356,145 A 10/1994 Verschoor
5,362,053 A 11/1994 Miller
5,374,061 A 12/1994 Albrecht
5,377,973 A 1/1995 Jones et al.
5,382,024 A 1/1995 Blaha
5,382,025 A 1/1995 Sklansky et al.
5,390,910 A 2/1995 Mandel et al.
5,397,128 A 3/1995 Hesse et al.
5,397,133 A 3/1995 Penzias
5,416,308 A 5/1995 Hood et al.
5,431,399 A 7/1995 Kelley
5,431,407 A 7/1995 Hofberg et al.
5,437,462 A 8/1995 Breeding
5,445,377 A 8/1995 Steinbach
5,470,079 A 11/1995 LeStrange et al.
D365,853 S 1/1996 Zadro
5,489,101 A 2/1996 Moody
5,515,477 A 5/1996 Sutherland
5,524,888 A 6/1996 Heidel
5,531,448 A 7/1996 Moody
5,544,892 A 8/1996 Breeding
5,575,475 A 11/1996 Steinbach
5,584,483 A 12/1996 Sines et al.
5,586,766 A 12/1996 Forte et al.
5,586,936 A 12/1996 Bennett et al.
5,605,334 A 2/1997 McCrea, Jr.
5,613,912 A 3/1997 Slater
5,632,483 A 5/1997 Garczynski et al.
5,636,843 A 6/1997 Roberts
5,651,548 A 7/1997 French et al.
5,655,961 A 8/1997 Acres et al.
5,655,966 A 8/1997 Werdin, Jr. et al.
5,669,816 A 9/1997 Garczynski et al.
5,676,231 A 10/1997 Legras et al.
5,676,372 A 10/1997 Sines et al.
5,681,039 A 10/1997 Miller
5,683,085 A 11/1997 Johnson et al.
5,685,543 A 11/1997 Garner
5,690,324 A 11/1997 Otomo et al.
5,692,748 A 12/1997 Frisco et al.
5,695,189 A 12/1997 Breeding et al.
5,701,565 A 12/1997 Morgan
5,707,286 A 1/1998 Carlson
5,707,287 A 1/1998 McCrea, Jr.
5,711,525 A 1/1998 Breeding
5,718,427 A 2/1998 Cranford et al.
5,719,288 A 2/1998 Sens et al.
5,720,484 A 2/1998 Hsu
5,722,893 A 3/1998 Hill et al.
5,735,525 A 4/1998 McCrea, Jr.
5,735,724 A 4/1998 Udagawa
5,735,742 A 4/1998 French
5,743,798 A 4/1998 Adams et al.
5,768,382 A 6/1998 Schneier et al.
5,770,533 A 6/1998 Franchi
5,770,553 A 6/1998 Kroner et al.
5,772,505 A 6/1998 Garczynski et al.
5,779,546 A 7/1998 Meissner et al.
5,781,647 A 7/1998 Fishbine et al.
5,785,321 A 7/1998 van Putten et al.
5,788,574 A 8/1998 Ornstein et al.
5,791,988 A 8/1998 Nomi
5,802,560 A 9/1998 Joseph et al.
5,803,808 A 9/1998 Strisower
5,810,355 A 9/1998 Trilli
5,813,326 A 9/1998 Salomon
5,813,912 A 9/1998 Shultz
5,814,796 A 9/1998 Benson
5,836,775 A 11/1998 Hiyama et al.
5,839,730 A 11/1998 Pike
5,845,906 A 12/1998 Wirth
5,851,011 A 12/1998 Lott
5,867,586 A 2/1999 Liang
5,879,233 A 3/1999 Stupero
5,883,804 A 3/1999 Christensen
5,890,717 A 4/1999 Rosewarne et al.
5,892,210 A 4/1999 Levasseur
5,909,876 A 6/1999 Brown
5,911,626 A 6/1999 McCrea, Jr.
5,919,090 A 7/1999 Mothwurf
D412,723 S 8/1999 Hachuel et al.
5,936,222 A 8/1999 Korsunsky
5,941,769 A 8/1999 Order
5,944,310 A 8/1999 Johnson et al.
D414,527 S 9/1999 Tedham
5,957,776 A 9/1999 Hoehne
5,974,150 A 10/1999 Kaish et al.
5,989,122 A 11/1999 Roblejo
5,991,308 A 11/1999 Fuhrmann et al.
6,015,311 A 1/2000 Benjamin et al.
6,019,368 A 2/2000 Sines et al.
6,019,374 A 2/2000 Breeding
6,039,650 A 3/2000 Hill
6,050,569 A 4/2000 Taylor
6,053,695 A 4/2000 Longoria et al.
6,061,449 A 5/2000 Candelore et al.
6,068,258 A 5/2000 Breeding et al.
6,069,564 A 5/2000 Hatano et al.
6,071,190 A 6/2000 Weiss et al.
6,093,103 A 7/2000 McCrea, Jr.
6,113,101 A 9/2000 Wirth
6,117,012 A 9/2000 McCrea, Jr.
D432,588 S 10/2000 Tedham
6,126,166 A 10/2000 Lorson et al.
6,131,817 A 10/2000 Miller
6,139,014 A 10/2000 Breeding et al.
6,149,154 A 11/2000 Grauzer et al.
6,154,131 A 11/2000 Jones, II et al.
6,165,069 A 12/2000 Sines et al.
6,165,072 A 12/2000 Davis et al.
6,183,362 B1 2/2001 Boushy
6,186,895 B1 2/2001 Oliver
6,196,416 B1 3/2001 Seagle

(56) References Cited

U.S. PATENT DOCUMENTS 6,200,218 B1 3/2001 Lindsay
6,210,274 B1 4/2001 Carlson
6,213,310 B1 4/2001 Wennersten et al.
6,217,447 B1 4/2001 Lofink et al.
6,234,900 B1 5/2001 Cumbers
6,236,223 B1 5/2001 Brady et al.
6,250,632 B1 6/2001 Albrecht
6,254,002 B1 7/2001 Litman
6,254,096 B1 7/2001 Grauzer et al.
6,254,484 B1 7/2001 McCrea, Jr.
6,257,981 B1 7/2001 Acres et al.
6,267,248 B1 7/2001 Johnson et al.
6,267,648 B1 7/2001 Katayama et al.
6,267,671 B1 7/2001 Hogan
6,270,404 B2 8/2001 Sines et al.
6,272,223 B1 8/2001 Carlson
6,293,546 B1 9/2001 Hessing et al.
6,293,864 B1 9/2001 Romero
6,299,167 B1 10/2001 Sines et al.
6,299,534 B1 10/2001 Breeding et al.
6,299,536 B1 10/2001 Hill
6,308,886 B1 10/2001 Benson et al.
6,313,871 B1 11/2001 Schubert
6,325,373 B1 12/2001 Breeding et al.
6,334,614 B1 1/2002 Breeding
6,341,778 B1 1/2002 Lee
6,342,830 B1 1/2002 Want et al.
6,346,044 B1 2/2002 McCrea, Jr.
6,361,044 B1 3/2002 Block
6,386,973 B1 5/2002 Yoseloff
6,402,142 B1 6/2002 Warren et al.
6,403,908 B2 6/2002 Stardust et al.
6,443,839 B2 9/2002 Stockdale et al.
6,446,864 B1 9/2002 Kim et al.
6,454,266 B1 9/2002 Breeding et al.
6,460,848 B1 10/2002 Soltys et al.
6,464,584 B2 10/2002 Oliver
6,490,277 B1 12/2002 Tzotzkov
6,508,709 B1 1/2003 Karmarkar
6,514,140 B1 2/2003 Storch
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,532,297 B1 3/2003 Lindquist
6,533,276 B2 3/2003 Soltys et al.
6,533,662 B2 3/2003 Soltys et al.
6,561,897 B1 5/2003 Bourbour et al.
6,568,678 B2 5/2003 Breeding et al.
6,579,180 B2 6/2003 Soltys et al.
6,579,181 B2 6/2003 Soltys et al.
6,581,747 B1 6/2003 Charlier et al.
6,582,301 B2 6/2003 Hill
6,582,302 B2 6/2003 Romero
6,585,586 B1 7/2003 Romero
6,585,588 B2 7/2003 Hard
6,585,856 B2 7/2003 Zwick et al.
6,588,750 B1 7/2003 Grauzer et al.
6,588,751 B1 7/2003 Grauzer et al.
6,595,857 B2 7/2003 Soltys et al.
6,609,710 B1 8/2003 Order
6,612,928 B1 9/2003 Bradford et al.
6,616,535 B1 9/2003 Nishizaki et al.
6,619,662 B2 9/2003 Miller
6,622,185 B1 9/2003 Johnson et al.
6,626,757 B2 9/2003 Oliveras
6,629,019 B2 9/2003 Legge et al.
6,629,591 B1 10/2003 Griswold et al.
6,629,889 B2 10/2003 Mothwurf
6,629,894 B1 10/2003 Purton
6,637,622 B1 10/2003 Robinson
6,638,161 B2 10/2003 Soltys et al.
6,645,068 B1 11/2003 Kelly et al.
6,645,077 B2 11/2003 Rowe
6,651,981 B2 11/2003 Grauzer et al.
6,651,982 B2 11/2003 Grauzer et al.
6,651,985 B2 11/2003 Sines et al.
6,652,379 B2 11/2003 Soltys et al.
6,655,684 B2 12/2003 Grauzer et al.
6,655,690 B1 12/2003 Oskwarek
6,658,135 B1 12/2003 Morito et al.
6,659,460 B2 12/2003 Blaha et al.
6,659,461 B2 12/2003 Yoseloff
6,659,875 B2 12/2003 Purton
6,663,490 B2 12/2003 Soltys et al.
6,666,768 B1 12/2003 Akers
6,671,358 B1 12/2003 Seidman et al.
6,676,127 B2 1/2004 Johnson et al.
6,676,517 B2 1/2004 Beavers
6,680,843 B2 1/2004 Farrow et al.
6,685,564 B2 2/2004 Oliver
6,685,567 B2 2/2004 Cockerille et al.
6,685,568 B2 2/2004 Soltys et al.
6,688,597 B2 2/2004 Jones
6,688,979 B2 2/2004 Soltys et al.
6,690,673 B1 2/2004 Jarvis
6,698,756 B1 3/2004 Baker et al.
6,698,759 B2 3/2004 Webb et al.
6,702,289 B1 3/2004 Feola
6,702,290 B2 3/2004 Buono-Correa et al.
6,709,333 B1 3/2004 Bradford et al.
6,712,696 B2 3/2004 Soltys et al.
6,719,288 B2 4/2004 Hessing et al.
6,719,634 B2 4/2004 Mishina et al.
6,722,974 B2 4/2004 Sines et al.
6,726,205 B1 4/2004 Purton
6,732,067 B1 5/2004 Powderly
6,733,012 B2 5/2004 Bui et al.
6,733,388 B2 5/2004 Mothwurf
6,746,333 B1 6/2004 Onda et al.
6,747,560 B2 6/2004 Stevens, III
6,749,510 B2 6/2004 Giobbi
6,758,751 B2 7/2004 Soltys et al.
6,758,757 B2 7/2004 Luciano, Jr. et al.
6,769,693 B2 8/2004 Huard et al.
6,774,782 B2 8/2004 Runyon et al.
6,789,801 B2 9/2004 Snow
6,802,510 B1 10/2004 Haber
6,804,763 B1 10/2004 Stockdale et al.
6,808,173 B2 10/2004 Snow
6,827,282 B2 12/2004 Silverbrook
6,834,251 B1 12/2004 Fletcher
6,840,517 B2 1/2005 Snow et al.
6,842,263 B1 1/2005 Saeki
6,843,725 B2 1/2005 Nelson
6,848,616 B2 2/2005 Tsirline et al.
6,848,844 B2 2/2005 McCue, Jr. et al.
6,848,994 B1 2/2005 Knust et al.
6,857,961 B2 2/2005 Soltys et al.
6,874,784 B1 4/2005 Promutico et al.
6,874,786 B2 4/2005 Bruno
6,877,657 B2 4/2005 Ranard et al.
6,877,748 B1 4/2005 Patroni et al.
6,886,829 B2 5/2005 Hessing et al.
6,889,979 B2 5/2005 Blaha et al.
6,893,347 B1 5/2005 Zilliacus et al.
6,899,628 B2 5/2005 Leen et al.
6,902,167 B2 6/2005 Webb
6,905,121 B1 6/2005 Timpano
6,923,446 B2 8/2005 Snow
6,938,900 B2 9/2005 Snow
6,941,180 B1 9/2005 Fisher et al.
6,950,948 B2 9/2005 Neff
6,955,599 B2 10/2005 Bourbour et al.
6,957,746 B2 10/2005 Martin et al.
6,959,925 B1 11/2005 Baker et al.
6,960,134 B2 11/2005 Hartl et al.
6,964,612 B2 11/2005 Soltys et al.
6,986,514 B2 1/2006 Snow
6,988,516 B2 1/2006 Debaes
7,011,309 B2 3/2006 Soltys et al.
7,020,307 B2 3/2006 Hinton et al.

(56) References Cited

U.S. PATENT DOCUMENTS

| | | | |
|---|---|---|---|
| 7,028,598 | B2 | 4/2006 | Teshima |
| 7,029,009 | B2 | 4/2006 | Grauzer et al. |
| 7,036,818 | B2 | 5/2006 | Grauzer et al. |
| 7,046,458 | B2 | 5/2006 | Nakayama |
| 7,046,764 | B1 | 5/2006 | Kump |
| 7,048,629 | B2 | 5/2006 | Sines et al. |
| 7,059,602 | B2 | 6/2006 | Grauzer et al. |
| 7,066,464 | B2 | 6/2006 | Blad et al. |
| 7,068,822 | B2 | 6/2006 | Scott |
| 7,073,791 | B2 | 7/2006 | Grauzer et al. |
| 7,079,010 | B2 | 7/2006 | Champlin |
| 7,084,769 | B2 | 8/2006 | Bauer et al. |
| 7,089,420 | B1 | 8/2006 | Durst et al. |
| D527,900 | S | 9/2006 | Dewa |
| 7,106,201 | B2 | 9/2006 | Tuttle |
| 7,113,094 | B2 | 9/2006 | Garber et al. |
| 7,114,718 | B2 | 10/2006 | Grauzer et al. |
| 7,124,947 | B2 | 10/2006 | Storch |
| 7,128,652 | B1 | 10/2006 | Lavoie et al. |
| 7,137,627 | B2 | 11/2006 | Grauzer et al. |
| 7,139,108 | B2 | 11/2006 | Andersen et al. |
| 7,140,614 | B2 | 11/2006 | Snow |
| 7,162,035 | B1 | 1/2007 | Durst et al. |
| 7,165,769 | B2 | 1/2007 | Crenshaw et al. |
| 7,165,770 | B2 | 1/2007 | Snow |
| 7,175,522 | B2 | 2/2007 | Hartl |
| 7,186,181 | B2 | 3/2007 | Rowe |
| 7,201,656 | B2 | 4/2007 | Darder |
| 7,202,888 | B2 | 4/2007 | Tecu et al. |
| 7,203,841 | B2 | 4/2007 | Jackson et al. |
| 7,213,812 | B2 | 5/2007 | Schubert |
| 7,222,852 | B2 | 5/2007 | Soltys |
| 7,222,855 | B2 | 5/2007 | Sorge |
| 7,231,812 | B1 | 6/2007 | Lagare |
| 7,234,698 | B2 | 6/2007 | Grauzer et al. |
| 7,237,969 | B2 | 7/2007 | Bartman |
| 7,243,148 | B2 | 7/2007 | Keir et al. |
| 7,243,698 | B2 | 7/2007 | Siegel |
| 7,246,799 | B2 | 7/2007 | Snow |
| 7,255,344 | B2 | 8/2007 | Grauzer et al. |
| 7,255,351 | B2 | 8/2007 | Yoseloff et al. |
| 7,255,642 | B2 | 8/2007 | Sines et al. |
| 7,257,630 | B2 | 8/2007 | Cole et al. |
| 7,261,294 | B2 | 8/2007 | Grauzer et al. |
| 7,264,241 | B2 | 9/2007 | Schubert et al. |
| 7,264,243 | B2 | 9/2007 | Yoseloff et al. |
| 7,277,570 | B2 | 10/2007 | Armstrong |
| 7,278,923 | B2 | 10/2007 | Grauzer et al. |
| 7,294,056 | B2 | 11/2007 | Lowell et al. |
| 7,297,062 | B2 | 11/2007 | Gatto et al. |
| 7,300,056 | B2 | 11/2007 | Gioia et al. |
| 7,303,473 | B2 | 12/2007 | Rowe |
| 7,303,475 | B2 | 12/2007 | Britt et al. |
| 7,309,065 | B2 | 12/2007 | Yoseloff et al. |
| 7,316,609 | B2 | 1/2008 | Dunn et al. |
| 7,316,615 | B2 | 1/2008 | Soltys et al. |
| 7,322,576 | B2 | 1/2008 | Grauzer et al. |
| 7,331,579 | B2 | 2/2008 | Snow |
| 7,334,794 | B2 | 2/2008 | Snow |
| 7,338,044 | B2 | 3/2008 | Grauzer et al. |
| 7,338,362 | B1 | 3/2008 | Gallagher |
| 7,341,510 | B2 | 3/2008 | Bourbour et al. |
| D566,784 | S | 4/2008 | Palmer |
| 7,357,321 | B2 | 4/2008 | Yoshida |
| 7,360,094 | B2 | 4/2008 | Neff |
| 7,367,561 | B2 | 5/2008 | Blaha et al. |
| 7,367,563 | B2 | 5/2008 | Yoseloff et al. |
| 7,367,565 | B2 | 5/2008 | Chiu |
| 7,367,884 | B2 | 5/2008 | Breeding et al. |
| 7,374,170 | B2 | 5/2008 | Grauzer et al. |
| 7,384,044 | B2 | 6/2008 | Grauzer et al. |
| 7,387,300 | B2 | 6/2008 | Snow |
| 7,389,990 | B2 | 6/2008 | Mourad |
| 7,390,256 | B2 | 6/2008 | Soltys et al. |
| 7,399,226 | B2 | 7/2008 | Mishra |
| 7,407,438 | B2 | 8/2008 | Schubert et al. |
| 7,413,191 | B2 | 8/2008 | Grauzer et al. |
| 7,434,805 | B2 | 10/2008 | Grauzer et al. |
| 7,436,957 | B1 | 10/2008 | Fisher et al. |
| 7,448,626 | B2 | 11/2008 | Fleckenstein |
| 7,458,582 | B2 | 12/2008 | Snow et al. |
| 7,461,843 | B1 | 12/2008 | Baker et al. |
| 7,464,932 | B2 | 12/2008 | Darling |
| 7,464,934 | B2 | 12/2008 | Schwartz |
| 7,472,906 | B2 | 1/2009 | Shai |
| 7,478,813 | B1 | 1/2009 | Hofferber et al. |
| 7,500,672 | B2 | 3/2009 | Ho |
| 7,506,874 | B2 | 3/2009 | Hall |
| 7,510,186 | B2 | 3/2009 | Fleckenstein |
| 7,510,190 | B2 | 3/2009 | Snow et al. |
| 7,510,194 | B2 | 3/2009 | Soltys et al. |
| 7,510,478 | B2 | 3/2009 | Benbrahim et al. |
| 7,513,437 | B2 | 4/2009 | Douglas |
| 7,515,718 | B2 | 4/2009 | Nguyen et al. |
| 7,523,935 | B2 | 4/2009 | Grauzer et al. |
| 7,523,936 | B2 | 4/2009 | Grauzer et al. |
| 7,523,937 | B2 | 4/2009 | Fleckenstein |
| 7,525,510 | B2 | 4/2009 | Beland et al. |
| 7,537,216 | B2 | 5/2009 | Soltys et al. |
| 7,540,497 | B2 | 6/2009 | Tseng |
| 7,540,498 | B2 | 6/2009 | Crenshaw et al. |
| 7,549,643 | B2 | 6/2009 | Quach |
| 7,554,753 | B2 | 6/2009 | Wakamiya |
| 7,556,197 | B2 | 7/2009 | Yoshida |
| 7,556,266 | B2 | 7/2009 | Blaha et al. |
| 7,575,237 | B2 | 8/2009 | Snow |
| 7,578,506 | B2 | 8/2009 | Lambert |
| 7,584,962 | B2 | 9/2009 | Breeding et al. |
| 7,584,963 | B2 | 9/2009 | Krenn et al. |
| 7,584,966 | B2 | 9/2009 | Snow |
| 7,591,728 | B2 | 9/2009 | Gioia et al. |
| 7,593,544 | B2 | 9/2009 | Downs |
| 7,594,660 | B2 | 9/2009 | Baker et al. |
| 7,597,623 | B2 | 10/2009 | Grauzer et al. |
| 7,644,923 | B1 | 1/2010 | Dickinson et al. |
| 7,661,676 | B2 | 2/2010 | Smith et al. |
| 7,666,090 | B2 | 2/2010 | Hettinger |
| 7,669,852 | B2 | 3/2010 | Baker et al. |
| 7,669,853 | B2 | 3/2010 | Jones |
| 7,677,565 | B2 | 3/2010 | Grauzer et al. |
| 7,677,566 | B2 | 3/2010 | Krenn et al. |
| 7,686,681 | B2 | 3/2010 | Soltys et al. |
| 7,699,694 | B2 | 4/2010 | Hill |
| 7,735,657 | B2 | 6/2010 | Johnson |
| 7,740,244 | B2 | 6/2010 | Ho |
| 7,744,452 | B2 | 6/2010 | Cimring et al. |
| 7,753,373 | B2 | 7/2010 | Grauzer et al. |
| 7,753,374 | B2 | 7/2010 | Ho |
| 7,753,798 | B2 | 7/2010 | Soltys |
| 7,758,425 | B2 | 7/2010 | Poh et al. |
| 7,762,554 | B2 | 7/2010 | Ho |
| 7,764,836 | B2 | 7/2010 | Downs et al. |
| 7,766,332 | B2 | 8/2010 | Grauzer et al. |
| 7,766,333 | B1 | 8/2010 | Stardust |
| 7,769,232 | B2 | 8/2010 | Downs, III |
| 7,769,853 | B2 | 8/2010 | Nezamzadeh |
| 7,773,749 | B1 | 8/2010 | Durst et al. |
| 7,780,529 | B2 | 8/2010 | Rowe et al. |
| 7,784,790 | B2 | 8/2010 | Grauzer et al. |
| 7,804,982 | B2 | 9/2010 | Howard et al. |
| 7,846,020 | B2 | 12/2010 | Walker et al. |
| 7,867,080 | B2 | 1/2011 | Nicely et al. |
| 7,890,365 | B2 | 2/2011 | Hettinger |
| 7,900,923 | B2 | 3/2011 | Toyama et al. |
| 7,901,285 | B2 | 3/2011 | Tran et al. |
| 7,908,169 | B2 | 3/2011 | Hettinger |
| 7,909,689 | B2 | 3/2011 | Lardie |
| 7,933,448 | B2 | 4/2011 | Downs, III |
| 7,946,586 | B2 | 5/2011 | Krenn et al. |
| 7,967,294 | B2 | 6/2011 | Blaha et al. |
| 7,976,023 | B1 | 7/2011 | Hessing et al. |
| 7,931,533 | B2 | 8/2011 | LeMay et al. |
| 7,988,152 | B2 | 8/2011 | Sines et al. |
| 7,988,554 | B2 | 8/2011 | LeMay et al. |

(56) References Cited

U.S. PATENT DOCUMENTS 7,995,196 B1 8/2011 Fraser
8,002,638 B2 8/2011 Grauzer et al.
8,011,661 B2 9/2011 Stasson
8,016,663 B2 9/2011 Soltys et al.
8,021,231 B2 9/2011 Walker et al.
8,025,294 B2 9/2011 Grauzer et al.
8,038,521 B2 10/2011 Grauzer et al.
RE42,944 E 11/2011 Blaha et al.
8,057,302 B2 11/2011 Wells et al.
8,062,134 B2 11/2011 Kelly et al.
8,070,574 B2 12/2011 Grauzer et al.
8,092,307 B2 1/2012 Kelly
8,092,309 B2 1/2012 Bickley
8,109,514 B2 2/2012 Toyama
8,141,875 B2 3/2012 Grauzer et al.
8,150,158 B2 4/2012 Downs, III
8,171,567 B1 5/2012 Fraser et al.
8,210,536 B2 7/2012 Blaha et al.
8,221,244 B2 7/2012 French
8,251,293 B2 8/2012 Nagata et al.
8,267,404 B2 9/2012 Grauzer et al.
8,270,603 B1 9/2012 Durst et al.
8,287,347 B2 10/2012 Snow et al.
8,287,386 B2 10/2012 Miller et al.
8,319,666 B2 11/2012 Weinmann et al.
8,337,296 B2 12/2012 Grauzer et al.
8,342,525 B2 1/2013 Scheper et al.
8,342,526 B1 1/2013 Sampson
8,342,529 B2 1/2013 Snow
8,353,513 B2 1/2013 Swanson
8,381,918 B2 2/2013 Johnson
8,419,521 B2 4/2013 Grauzer et al.
8,429,229 B2 4/2013 Sepich et al.
8,444,147 B2 5/2013 Grauzer et al.
8,444,489 B2 5/2013 Lian et al.
8,469,360 B2 6/2013 Sines
8,475,252 B2 7/2013 Savage et al.
8,480,088 B2 7/2013 Toyama et al.
8,485,527 B2 7/2013 Sampson et al.
8,490,973 B2 7/2013 Yoseloff et al.
8,498,444 B2 7/2013 Sharma
8,505,916 B2 8/2013 Grauzer et al.
8,511,684 B2 8/2013 Grauzer et al.
8,512,146 B2 8/2013 Gururajan et al.
8,548,327 B2 10/2013 Hirth et al.
8,556,263 B2 10/2013 Grauzer et al.
8,579,289 B2 11/2013 Rynda et al.
8,602,416 B2 12/2013 Toyama
8,616,552 B2 12/2013 Czyzewski et al.
8,628,086 B2 1/2014 Krenn et al.
8,651,485 B2 2/2014 Stasson
8,662,500 B2 3/2014 Swanson
8,695,978 B1 4/2014 Ho
8,702,100 B2 4/2014 Snow et al.
8,702,101 B2 4/2014 Scheper et al.
8,720,891 B2 5/2014 Hessing et al.
8,758,111 B2 6/2014 Lutnick
8,777,710 B2 7/2014 Grauzer et al.
8,820,745 B2 9/2014 Grauzer et al.
8,844,930 B2 9/2014 Sampson
8,899,587 B2 12/2014 Grauzer et al.
8,919,775 B2 12/2014 Wadds et al.
9,101,821 B2 8/2015 Snow
9,251,661 B2 2/2016 Tammesoo
9,266,012 B2 2/2016 Grauzer
9,280,866 B2 3/2016 Nayak et al.
9,474,957 B2 * 10/2016 Haushalter ..... A63F 1/14
9,504,905 B2 11/2016 Kelly et al.
9,511,274 B2 12/2016 Kelly et al.
9,566,501 B2 2/2017 Stasson et al.
9,731,190 B2 8/2017 Sampson et al.
2001/0036231 A1 11/2001 Easwar et al.
2001/0036866 A1 11/2001 Stockdale et al.
2002/0017481 A1 2/2002 Johnson et al.
2002/0030425 A1 3/2002 Tiramani et al.
2002/0045478 A1 4/2002 Soltys et al.
2002/0045481 A1 4/2002 Soltys et al.
2002/0063389 A1 5/2002 Breeding et al.
2002/0068635 A1 6/2002 Hill
2002/0070499 A1 6/2002 Breeding et al.
2002/0094869 A1 7/2002 Harkham
2002/0107067 A1 8/2002 McGlone et al.
2002/0107072 A1 8/2002 Giobbi
2002/0113368 A1 8/2002 Hessing et al.
2002/0135692 A1 9/2002 Fujinawa
2002/0142820 A1 10/2002 Bartlett
2002/0155869 A1 10/2002 Soltys et al.
2002/0163122 A1 11/2002 Vancura
2002/0163125 A1 11/2002 Grauzer et al.
2002/0187821 A1 12/2002 Soltys et al.
2002/0187830 A1 12/2002 Stockdale et al.
2003/0003997 A1 1/2003 Vuong et al.
2003/0007143 A1 1/2003 McArthur et al.
2003/0042673 A1 3/2003 Grauzer
2003/0047870 A1 3/2003 Blaha et al.
2003/0048476 A1 3/2003 Yamakawa
2003/0052449 A1 3/2003 Grauzer et al.
2003/0052450 A1 3/2003 Grauzer et al.
2003/0064798 A1 4/2003 Grauzer et al.
2003/0067112 A1 4/2003 Grauzer et al.
2003/0071413 A1 4/2003 Blaha et al.
2003/0073498 A1 4/2003 Grauzer et al.
2003/0075865 A1 4/2003 Grauzer et al.
2003/0075866 A1 4/2003 Blaha et al.
2003/0087694 A1 5/2003 Storch
2003/0090059 A1 5/2003 Grauzer et al.
2003/0094756 A1 5/2003 Grauzer et al.
2003/0151194 A1 8/2003 Hessing et al.
2003/0195025 A1 10/2003 Hill
2004/0015423 A1 1/2004 Walker et al.
2004/0036214 A1 2/2004 Baker et al.
2004/0067789 A1 4/2004 Grauzer et al.
2004/0100026 A1 5/2004 Haggard
2004/0108654 A1 6/2004 Grauzer et al.
2004/0116179 A1 6/2004 Nicely et al.
2004/0169332 A1 9/2004 Grauzer et al.
2004/0180722 A1 9/2004 Giobbi
2004/0224777 A1 11/2004 Smith et al.
2004/0245720 A1 12/2004 Grauzer et al.
2004/0259618 A1 12/2004 Soltys et al.
2005/0012671 A1 1/2005 Bisig
2005/0012818 A1 1/2005 Kiely et al.
2005/0023752 A1 2/2005 Grauzer et al.
2005/0026680 A1 2/2005 Gururajan
2005/0035548 A1 2/2005 Yoseloff
2005/0037843 A1 2/2005 Wells et al.
2005/0040594 A1 2/2005 Krenn et al.
2005/0051955 A1 3/2005 Schubert et al.
2005/0051956 A1 3/2005 Grauzer et al.
2005/0062227 A1 3/2005 Grauzer et al.
2005/0062228 A1 3/2005 Grauzer et al.
2005/0062229 A1 3/2005 Grauzer et al.
2005/0082750 A1 4/2005 Grauzer et al.
2005/0093231 A1 5/2005 Grauzer et al.
2005/0104289 A1 5/2005 Grauzer et al.
2005/0104290 A1 5/2005 Grauzer et al.
2005/0110210 A1 5/2005 Soltys et al.
2005/0113166 A1 5/2005 Grauzer et al.
2005/0113171 A1 5/2005 Hodgson
2005/0119048 A1 6/2005 Soltys
2005/0121852 A1 6/2005 Soltys et al.
2005/0137005 A1 6/2005 Soltys et al.
2005/0140090 A1 6/2005 Breeding et al.
2005/0146093 A1 7/2005 Grauzer et al.
2005/0148391 A1 7/2005 Tain
2005/0164759 A1 7/2005 Smith et al.
2005/0164761 A1 7/2005 Tain
2005/0192092 A1 9/2005 Breckner et al.
2005/0206077 A1 9/2005 Grauzer et al.
2005/0242500 A1 11/2005 Downs
2005/0272501 A1 12/2005 Tran et al.
2005/0277463 A1 12/2005 Knust et al.
2005/0288083 A1 12/2005 Downs
2005/0288086 A1 12/2005 Schubert et al.

(56) References Cited

U.S. PATENT DOCUMENTS

| | | | |
|---|---|---|---|
| 2006/0027970 | A1 | 2/2006 | Kyrychenko |
| 2006/0033269 | A1 | 2/2006 | Grauzer et al. |
| 2006/0033270 | A1 | 2/2006 | Grauzer et al. |
| 2006/0046853 | A1 | 3/2006 | Black |
| 2006/0063577 | A1 | 3/2006 | Downs, III et al. |
| 2006/0066048 | A1 | 3/2006 | Krenn et al. |
| 2006/0181022 | A1 | 8/2006 | Grauzer et al. |
| 2006/0183540 | A1 | 8/2006 | Grauzer et al. |
| 2006/0189381 | A1 | 8/2006 | Daniel et al. |
| 2006/0199649 | A1 | 9/2006 | Soltys et al. |
| 2006/0205508 | A1 | 9/2006 | Green |
| 2006/0220312 | A1 | 10/2006 | Baker et al. |
| 2006/0220313 | A1 | 10/2006 | Baker et al. |
| 2006/0252521 | A1 | 11/2006 | Gururajan et al. |
| 2006/0252554 | A1 | 11/2006 | Gururajan et al. |
| 2006/0279040 | A1 | 12/2006 | Downs et al. |
| 2006/0281534 | A1 | 12/2006 | Grauzer et al. |
| 2007/0001395 | A1 | 1/2007 | Gioia et al. |
| 2007/0006708 | A1 | 1/2007 | Laakso |
| 2007/0015583 | A1 | 1/2007 | Tran |
| 2007/0018389 | A1 | 1/2007 | Downs, III |
| 2007/0045959 | A1 | 3/2007 | Soltys |
| 2007/0049368 | A1 | 3/2007 | Kuhn et al. |
| 2007/0057469 | A1 | 3/2007 | Grauzer et al. |
| 2007/0066387 | A1 | 3/2007 | Matsuno et al. |
| 2007/0069462 | A1 | 3/2007 | Downs, III et al. |
| 2007/0072677 | A1 | 3/2007 | Lavoie et al. |
| 2007/0102879 | A1 | 5/2007 | Stasson |
| 2007/0111773 | A1 | 5/2007 | Gururajan et al. |
| 2007/0148283 | A1 | 6/2007 | Harvey et al. |
| 2007/0184905 | A1 | 8/2007 | Gatto et al. |
| 2007/0197294 | A1 | 8/2007 | Gong |
| 2007/0197298 | A1 | 8/2007 | Rowe |
| 2007/0202941 | A1 | 8/2007 | Miltenberger et al. |
| 2007/0222147 | A1 | 9/2007 | Blaha et al. |
| 2007/0225055 | A1 | 9/2007 | Weisman |
| 2007/0233567 | A1 | 10/2007 | Daly |
| 2007/0238506 | A1 | 10/2007 | Ruckle |
| 2007/0259709 | A1 | 11/2007 | Kelly et al. |
| 2007/0267812 | A1 | 11/2007 | Grauzer et al. |
| 2007/0272600 | A1 | 11/2007 | Johnson |
| 2007/0278739 | A1 | 12/2007 | Swanson |
| 2007/0287534 | A1 | 12/2007 | Fleckenstein |
| 2007/0290438 | A1 | 12/2007 | Grauzer et al. |
| 2008/0004107 | A1 | 1/2008 | Nguyen et al. |
| 2008/0006997 | A1 | 1/2008 | Scheper et al. |
| 2008/0006998 | A1 | 1/2008 | Grauzer et al. |
| 2008/0022415 | A1 | 1/2008 | Kuo et al. |
| 2008/0032763 | A1 | 2/2008 | Giobbi |
| 2008/0039192 | A1 | 2/2008 | Laut |
| 2008/0039208 | A1 | 2/2008 | Abrink et al. |
| 2008/0096656 | A1 | 4/2008 | LeMay et al. |
| 2008/0111300 | A1 | 5/2008 | Czyzewski et al. |
| 2008/0113700 | A1 | 5/2008 | Czyzewski et al. |
| 2008/0136108 | A1 | 6/2008 | Polay |
| 2008/0143048 | A1 | 6/2008 | Shigeta |
| 2008/0176627 | A1 | 7/2008 | Lardie |
| 2008/0217218 | A1 | 9/2008 | Johnson |
| 2008/0234046 | A1 | 9/2008 | Kinsley |
| 2008/0234047 | A1 | 9/2008 | Nguyen |
| 2008/0248875 | A1 | 10/2008 | Beatty |
| 2008/0284096 | A1 | 11/2008 | Toyama et al. |
| 2008/0303210 | A1 | 12/2008 | Grauzer et al. |
| 2008/0315517 | A1 | 12/2008 | Toyama et al. |
| 2009/0026700 | A2 | 1/2009 | Shigeta |
| 2009/0048026 | A1 | 2/2009 | French |
| 2009/0054161 | A1 | 2/2009 | Schuber et al. |
| 2009/0072477 | A1 | 3/2009 | Tseng et al. |
| 2009/0121429 | A1 | 3/2009 | Walsh et al. |
| 2009/0091078 | A1 | 4/2009 | Grauzer et al. |
| 2009/0100409 | A1 | 4/2009 | Toneguzzo |
| 2009/0104963 | A1 | 4/2009 | Burman |
| 2009/0134575 | A1 | 5/2009 | Dickinson et al. |
| 2009/0140492 | A1 | 6/2009 | Yoseloff et al. |
| 2009/0166970 | A1 | 7/2009 | Rosh et al. |
| 2009/0176547 | A1 | 7/2009 | Katz |
| 2009/0179378 | A1 | 7/2009 | Amaitis et al. |
| 2009/0186676 | A1 | 7/2009 | Amaitis et al. |
| 2009/0189346 | A1 | 7/2009 | Krenn et al. |
| 2009/0191933 | A1 | 7/2009 | French |
| 2009/0194988 | A1 | 8/2009 | Wright et al. |
| 2009/0197662 | A1 | 8/2009 | Wright et al. |
| 2009/0224476 | A1 | 9/2009 | Grauzer et al. |
| 2009/0227318 | A1 | 9/2009 | Wright et al. |
| 2009/0227360 | A1 | 9/2009 | Gioia et al. |
| 2009/0250873 | A1 | 10/2009 | Jones |
| 2009/0253478 | A1 | 10/2009 | Walker et al. |
| 2009/0253503 | A1 | 10/2009 | Krise et al. |
| 2009/0267296 | A1 | 10/2009 | Ho et al. |
| 2009/0267297 | A1 | 10/2009 | Blaha et al. |
| 2009/0283969 | A1 | 11/2009 | Tseng et al. |
| 2009/0298577 | A1 | 12/2009 | Gagner et al. |
| 2009/0302535 | A1 | 12/2009 | Ho et al. |
| 2009/0302537 | A1 | 12/2009 | Ho et al. |
| 2009/0312093 | A1 | 12/2009 | Walker et al. |
| 2009/0314188 | A1 | 12/2009 | Toyama et al. |
| 2010/0013152 | A1 | 1/2010 | Grauzer |
| 2010/0038849 | A1 | 2/2010 | Scheper et al. |
| 2010/0048304 | A1 | 2/2010 | Boesen |
| 2010/0069155 | A1 | 3/2010 | Schwartz et al. |
| 2010/0178987 | A1 | 7/2010 | Pacey |
| 2010/0197410 | A1 | 8/2010 | Leen et al. |
| 2010/0234110 | A1 | 9/2010 | Clarkson |
| 2010/0240440 | A1 | 9/2010 | Szrek et al. |
| 2010/0244376 | A1 | 9/2010 | Johnson |
| 2010/0244382 | A1 | 9/2010 | Snow |
| 2010/0252992 | A1 | 10/2010 | Sines |
| 2010/0255899 | A1 | 10/2010 | Paulsen |
| 2010/0276880 | A1 | 11/2010 | Grauzer et al. |
| 2010/0311493 | A1 | 12/2010 | Miller et al. |
| 2010/0311494 | A1 | 12/2010 | Miller et al. |
| 2010/0314830 | A1 | 12/2010 | Grauzer et al. |
| 2010/0320685 | A1 | 12/2010 | Grauzer |
| 2011/0006480 | A1 | 1/2011 | Grauzer |
| 2011/0012303 | A1 | 1/2011 | Kourgiantakis et al. |
| 2011/0024981 | A1 | 2/2011 | Tseng |
| 2011/0052049 | A1 | 3/2011 | Rajaraman et al. |
| 2011/0062662 | A1 | 3/2011 | Ohta |
| 2011/0078096 | A1 | 3/2011 | Bounds |
| 2011/0079959 | A1 | 4/2011 | Hartley |
| 2011/0105208 | A1 | 5/2011 | Bickley |
| 2011/0109042 | A1 | 5/2011 | Rynda |
| 2011/0130185 | A1 | 6/2011 | Walker |
| 2011/0130190 | A1 | 6/2011 | Hamman et al. |
| 2011/0159952 | A1 | 6/2011 | Kerr |
| 2011/0159953 | A1 | 6/2011 | Kerr |
| 2011/0165936 | A1 | 7/2011 | Kerr |
| 2011/0172008 | A1 | 7/2011 | Alderucci |
| 2011/0183748 | A1 | 7/2011 | Wilson et al. |
| 2011/0230268 | A1 | 9/2011 | Williams |
| 2011/0269529 | A1 | 11/2011 | Baerlocher |
| 2011/0272881 | A1 | 11/2011 | Sines |
| 2011/0285081 | A1 | 11/2011 | Stasson |
| 2011/0287829 | A1 | 11/2011 | Clarkson et al. |
| 2012/0015724 | A1 | 1/2012 | Ocko et al. |
| 2012/0015725 | A1 | 1/2012 | Ocko et al. |
| 2012/0015743 | A1 | 1/2012 | Lam et al. |
| 2012/0015747 | A1 | 1/2012 | Ocko et al. |
| 2012/0021835 | A1 | 1/2012 | Keller et al. |
| 2012/0034977 | A1 | 2/2012 | Kammler |
| 2012/0062745 | A1 | 3/2012 | Han et al. |
| 2012/0074646 | A1 | 3/2012 | Grauzer et al. |
| 2012/0091656 | A1 | 4/2012 | Blaha et al. |
| 2012/0095982 | A1 | 4/2012 | Lennington et al. |
| 2012/0161393 | A1 | 6/2012 | Krenn et al. |
| 2012/0175841 | A1 | 7/2012 | Grauzer |
| 2012/0181747 | A1 | 7/2012 | Grauzer et al. |
| 2012/0187625 | A1 | 7/2012 | Downs, III et al. |
| 2012/0242782 | A1 | 9/2012 | Huang |
| 2012/0286471 | A1 | 11/2012 | Grauzer et al. |
| 2012/0306152 | A1 | 12/2012 | Krishnamurty et al. |
| 2013/0020761 | A1 | 1/2013 | Sines et al. |
| 2013/0085638 | A1 | 4/2013 | Weinmann et al. |
| 2013/0099448 | A1 | 4/2013 | Scheper et al. |

(56) References Cited

U.S. PATENT DOCUMENTS

| | | | |
|---|---|---|---|
| 2013/0109455 | A1 | 5/2013 | Grauzer et al. |
| 2013/0132306 | A1 | 5/2013 | Kami et al. |
| 2013/0147116 | A1 | 6/2013 | Stasson |
| 2013/0161905 | A1 | 6/2013 | Grauzer et al. |
| 2013/0228972 | A1 | 9/2013 | Grauzer et al. |
| 2013/0300059 | A1 | 11/2013 | Sampson et al. |
| 2013/0337922 | A1 | 12/2013 | Kuhn |
| 2014/0027979 | A1 | 1/2014 | Stasson et al. |
| 2014/0094239 | A1 | 4/2014 | Grauzer et al. |
| 2014/0103606 | A1 | 4/2014 | Grauzer et al. |
| 2014/0138907 | A1 | 5/2014 | Rynda et al. |
| 2014/0145399 | A1 | 5/2014 | Krenn et al. |
| 2014/0171170 | A1 | 6/2014 | Krishnamurty et al. |
| 2014/0175724 | A1 | 6/2014 | Huhtala et al. |
| 2014/0183818 | A1 | 7/2014 | Czyzewski et al. |
| 2015/0021242 | A1 | 1/2015 | Johnson |
| 2015/0069699 | A1 | 3/2015 | Blazevic |
| 2015/0196834 | A1 | 7/2015 | Snow |
| 2017/0157499 | A1 | 6/2017 | Krenn et al. |

FOREIGN PATENT DOCUMENTS

| | | | |
|---|---|---|---|
| AU | 697805 | B2 | 10/1998 |
| AU | 757636 | B2 | 2/2003 |
| CA | 2266555 | A1 | 9/1996 |
| CA | 2284017 | A1 | 9/1998 |
| CA | 2612138 | A1 | 12/2006 |
| CN | 2051521 | U | 1/1990 |
| CN | 2848303 | Y | 12/2006 |
| CN | 2855481 | Y | 1/2007 |
| CN | 101025603 | A | 8/2007 |
| CN | 200954370 | Y | 10/2007 |
| CN | 200987893 | Y | 12/2007 |
| CN | 101099896 | A | 1/2008 |
| CN | 101127131 | A | 2/2008 |
| CN | 201085907 | Y | 7/2008 |
| CN | 201139926 | Y | 10/2008 |
| CN | 100571826 | C | 12/2009 |
| CN | 1771077 | B | 6/2010 |
| CN | 102125756 | A | 7/2011 |
| CN | 102170944 | A | 8/2011 |
| CN | 101783011 | B | 12/2011 |
| CN | 202983149 | U | 6/2013 |
| CZ | 24952 | U1 | 2/2013 |
| DE | 3807127 | A1 | 9/1989 |
| DE | 2757341 | A1 | 9/1998 |
| EP | 777514 | B1 | 2/2000 |
| EP | 1502631 | A1 | 2/2005 |
| EP | 1713026 | A1 | 10/2006 |
| EP | 1194888 | A1 | 8/2009 |
| EP | 2228106 | A1 | 9/2010 |
| EP | 1575261 | B1 | 8/2012 |
| FR | 2375918 | A1 | 7/1978 |
| GB | 337147 | A | 9/1929 |
| GB | 414014 | A | 7/1934 |
| GB | 672616 | A | 5/1952 |
| JP | 10063933 | A | 3/1998 |
| JP | 11045321 | A | 2/1999 |
| JP | 2000251031 | A | 9/2000 |
| JP | 2001327647 | A | 11/2001 |
| JP | 2002165916 | A | 6/2002 |
| JP | 2003250950 | A | 9/2003 |
| JP | 2005198668 | A | 7/2005 |
| JP | 2008246061 | A | 10/2008 |
| TW | M359356 | U | 6/2009 |
| WO | 8700764 | A1 | 2/1987 |
| WO | 9221413 | A1 | 12/1992 |
| WO | 9528210 | A1 | 10/1995 |
| WO | 9607153 | A1 | 3/1996 |
| WO | 9710577 | A1 | 3/1997 |
| WO | 9814249 | A1 | 4/1998 |
| WO | 9840136 | A1 | 9/1998 |
| WO | 9943404 | A1 | 9/1999 |
| WO | 9952610 | A1 | 10/1999 |
| WO | 9952611 | A1 | 10/1999 |
| WO | 200051076 | A1 | 8/2000 |
| WO | 156670 | A1 | 8/2001 |
| WO | 178854 | A3 | 10/2001 |
| WO | 205914 | A1 | 1/2002 |
| WO | 3026763 | A1 | 4/2003 |
| WO | 2004067889 | A1 | 12/2004 |
| WO | 2004112923 | A1 | 12/2004 |
| WO | 2006031472 | A2 | 3/2006 |
| WO | 2006039308 | A2 | 4/2006 |
| WO | 2008005286 | A2 | 1/2008 |
| WO | 2008006023 | A2 | 1/2008 |
| WO | 2008091809 | A2 | 7/2008 |
| WO | 2009067758 | A1 | 6/2009 |
| WO | 2009137541 | A2 | 11/2009 |
| WO | 2010001032 | A2 | 1/2010 |
| WO | 2010052573 | A2 | 5/2010 |
| WO | 2010055328 | A2 | 5/2010 |
| WO | 2010117446 | A2 | 10/2010 |
| WO | 2013019677 | A2 | 2/2013 |

OTHER PUBLICATIONS

"Ace, Single Deck Shuffler," Shuffle Master, Inc., (2005), 2 pages.
Advansys, "Player Tracking" http://advansys.si/products/tablescanner/player-tracking/[Sep. 23, 2016 1:41:34 PM], 4 pages.
Australian Examination Report for Australian Application No. 2008202752, dated Sep. 25, 2009, 2 pages.
Australian Examination Report for Australian Application No. 2010202856, dated Aug. 11, 2011, 2 pages.
Australian Provisional Patent Application for Australian Patent Application No. PM7441, filed Aug. 15, 1994, Applicants: Rodney G. Johnson et al., Title: Card Handling Apparatus, 13 pages.
"Automatic casino card shuffle," Alibaba.com, (last visited Jul. 22, 2014), 2 pages.
Bally Systems Catalogue, Ballytech.com/systems, 2012, 13 pages.
Canadian Office Action for CA 2,580,309 dated Mar. 20, 2012 (6 pages).
Canadian Office Action for Canadian Application No. 2,461,726, dated Jul. 19, 2010, 3 pages.
Canadian Office Action for Canadian Application No. 2,461,726, dated Dec. 11, 2013, 3 pages.
Christos Stergiou and Dimitrios Siganos, "Neural Networks," http://www.doc.ic.ac.uk/~nd/surprise_96/journal/vol4/cs11/report.html (13 pages), Dec. 15, 2011.
Complaint filed in the matter of *SHFL entertainment, In.* v. *DigiDeal Corporation*, U.S. District Court, District of Nevada, Civil Action No. CV 2:12-cv-01782-GMC-VCF, Oct. 10, 2012, 62 pages.
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 18 of 23 (color copies from Binder 1).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 1 of 23 (Master Index and Binder 1, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 2 of 23 (Master Index and Binder 1, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 3 of 23 (Binder 2, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 4 of 23 (Binder 2, 2 of 2).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 19 of 23 (color copies from Binder 3).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 5 of 23 (Binder 3, 1 of 2).

(56) References Cited

OTHER PUBLICATIONS

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 6 of 23 (Binder 3, 2 of 2).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 20 of 23 (color copies from Binder 4).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 7 of 23 (Binder 4, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 8 of 23 (Binder 4, 2 of 2).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 21 of 23 (color copies from Binder 6).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 10 of 23 (Binder 6, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 9 of 23 (Binder 5 having no contents; Binder 6, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 11 of 23 (Binder 7, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 12 of 23 (Binder 7, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 13 of 23 (Binder 8, 1 of 5).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 22 of 23 (color copies from Binder 8, part 1 of 2).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 23 of 23 (color copies from Binder 8, part 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 14 of 23 (Binder 8, 2 of 5).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 15 of 23 (Binder 8, 3 of 5).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 16 of 23 (Binder 8, 4 of 5).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 17 of 23 (Binder 8, 5 of 5).
DVD labeled Exhibit 1. This is a DVD taken by Shuffle Master personnel of the live operation of a CARD One25i| Shuffler (Oct. 7, 2003).
DVD labeled Morrill Decl. Ex. A is (see Binder 4-1, p. 149/206, Morrill Decl., para. 2.): A video (16 minutes) that the attorney for CARD, Robert Morrill, made to describe the Roblejo prototype card shuffler.
DVD labeled Solberg Decl.Ex.C, which is not a video at all, is (see Binder 4-1, p. 34/206, Solberg Decl., para.8): Computer source code for operating a computer-controlled card shuffler (an early Roblejo prototype card shuffler) and descriptive comments of how the code works.
DVD labeled Luciano Decl. Ex. K is (see Binder 2-1, p. 215/237, Luciano Decl., para.14): A video demonstration (11minutes) of a Luciano Packaging prototype shuffler.
European Search Report for European Application No. 12 152 303, dated Apr. 16, 2012, 3 pages.
European Patent Application Search Report—European Patent Application No. 06772987.1, dated Dec. 10, 2009, 5 pages.
European Examination Report for European Application No. 02 780 410, dated Jan. 25, 2010, 5 pages.
European Examination Report for European Application No. 02 780 410, dated Aug. 9, 2011, 4 pages.
"Error Back propagation," http://willamette.edu~gorr/classes/cs449/backprop.html (4 pages), Nov. 13, 2008.
"I-Deal," Bally Technologies, Inc., (2014), 2 pages.
"Shufflers—SHFL entertainment," Gaming Concepts Group, (2012), 6 pages.
"TAG Archives: Shuffle Machine," Gee Wiz Online, (Mar. 25, 2013), 4 pages.
Genevieve Orr, CS-449: Neural Networks Willamette University, http://www.willamette.edu/~gorr/classes/cs449/intro.html (4 pages), Fall 1999.
http://www.google.com/search?tbm=pts&q=Card+handling+devicve+with+Finput+and+outpu . . . Jun. 8, 2012.
http://www.ildado.com/casino_glossary.html, Feb. 1, 2001, p. 1-8.
https://web.archive.org/web/19991004000323/http://travelwizardtravel.com/majon.htm, Oct. 4, 1999, 2 pages.
http://www.google.com/search?tbm=pts&q=shuffling+zone+onOopposite+site+of+input+. . . Jul. 18, 2012.
Litwiller, Dave, CCD vs. CMOS: Facts and Fiction reprinted from Jan. 2001 Issue of Photonics Spectra, Laurin Publishing Co. Inc. (4 pages).
Malaysian Patent Application Substantive Examination Adverse Report—Malaysian Patent Application Serial No. PI20062710, dated May 9, 2009, 4 pages.
PCT International Preliminary Examination Report for International Patent Application No. PCT/US02/31105 dated Jul. 28, 2004, 9 pages.
PCT International Search Report for International Application No. PCT/US2003/015393, dated Oct. 6, 2003, 2 pages.
PCT International Search Report for PCT/US2005/034737 dated Apr. 7, 2006, 1 page.
PCT International Search Report for PCT/US2007/022894, dated Jun. 11, 2008, 3 pages.
PCT International Search Report and Written Opinion, PCT/US2012/48706, dated Oct. 16, 2012, 12 pages.
PCT International Search Report and Written Opinion of the International Searching Authority for PCT/US2010/001032, dated Jun. 16, 2010, 11 pages.
PCT International Search Report and Written Opinion for PCT/US07/15035, dated Sep. 29, 2008, 6 pages.
PCT International Search Report and Written Opinion for PCT/US07/15036, dated Sep. 23, 2008, 6 pages.
PCT International Search Report and Written Opinion, PCT Application No. PCT/US2015/051038, dated Jan. 22, 2016, 11 pages.
PCT International Search Report and Written Opinion of the International Searching Authority for PCT/US2008/007069, dated Sep. 8, 2008, 10 pages.
PCT International Search Report and Written Opinion, PCT Application No. PCT/US2015/022158, dated Jun. 17, 2015, 13 pages.
PCT International Search Report and Written Opinion for International Application No. PCT/US2007/023168, dated Sep. 12, 2008, 8 pages.
PCT International Search Report and Written Opinion, PCT Application No. PCT/US2015/040196, dated Jan. 15, 2016, 20 pages.

(56) References Cited

OTHER PUBLICATIONS

PCT International Search Report and Written Opinion, PCT Application No. PCT/US2013/062391, dated Dec. 17, 2013, 13 pages.
PCT International Search Report and Written Opinion of the International Searching Authority for PCT/US05/31400, dated Sep. 25, 2007, 12 pages.
PCT International Search Report and Written Opinion, PCT Application No. PCT/US2015/025420, dated Oct. 2, 2015, 15 pages.
PCT International Search Report and Written Opinion of the International Searching Authority for PCT/US13/59665, dated Apr. 25, 2014, 21 pages.
PCT International Search Report and Written Opinion of the International Searching Authority for PCT/IB2013/001756, dated Jan. 10, 2014, 7 pages.
PCT International Search Report and Written Opinion of the International Searching Authority for PCT/US11/59797, dated Mar. 27, 2012, 14 pages.
PCT International Search Report and Written Opinion for International Application No. PCT/US2007/022858, dated Mar. 7, 2008, 7 pages.
PCT International Search Report and Written Opinion for International Patent Application No. PCT/US2006/22911, dated Jun. 1, 2007, 6 pages.
PCT International Search Report and Written Opinion of the International Searching Authority for PCT/GB2011/051978, dated Jan. 17, 2012, 11 pages.
Philippines Patent Application Formality Examination Report—Philippines Patent Application No. 1-2006-000302, dated Jun. 13, 2006.
Press Release for Alliance Gaming Corp., Jul. 26, 2004—Alliance Gaming Announces Control with Galaxy Macau for New MindPlay Baccarat Table Technology, 2 pages, http://biz.yahoo.com/prnews.
Scarne's Encyclopedia of Games by John Scarne, 1973, "Super Contract Bridge", p. 153.
Shuffle Master Gaming, Service Manual, ACETM Single Deck Card Shuffler, (1998), 63 pages.
Shuffle Master Gaming, Service Manual, Let It Ride Bonus® With Universal Keypad, 112 pages, © 2000 Shuffle Master, Inc.
Service Manual/User Manual for Single Deck Shufflers: BG1, BG2 and BG3 by Shuffle Master © 1997, 151 page.
Singapore Patent Application Examination Report—Singapore Patent Application No. SE 2008 01914 A, dated Jun. 18, 2008, 9 pages.
SHFL Entertainment, Inc. Docket No. 60, Opening Claim Construction Brief, filed in Nevada District Court Case No. 2:12-cv-01782 with exhibits, Aug. 8, 2013, p. 1-125.
Shuffle Master's Reply Memorandum in Support of Shuffle Master's Motion for Preliminary Injunction for *Shuffle Master, Inc.* vs. *VendingData Corporation*, in the U.S. District Court, District of Nevada, No. CV-S-04-1373-JCM-LRL, Nov. 29, 2004.
Statement of Relevance of Cited References, Submitted as Part of a Third-Party Submission Under 37 CFR 1.290 on Dec. 7, 2012 (12 pages).
tbm=pts&hl=en Google Search for card handling device with storage area, card removing system pivoting arm and processor ; http://www.google.com/?tbrn=pts&hl=en; Jul. 28, 2012, 2 pages.
Tracking the Tables, by Jack Bularsky, Casino Journal, May 2004, vol. 17, No. 5, pp. 44-47.
United States Court of Appeals for the Federal Circuit Decision Decided Dec. 27, 2005 for Preliminary Injuction for *Shuffle Master, Inc.* vs. *VendingData Corporation*, In the U.S. District Court, District of Nevada, No. CV-S-04-1373-JCM-LRL.
VendingData Corporation's Answer and Counterclaim Jury Trial Demanded for *Shuffle Master, Inc.* vs. *VendingData Corporation*, In the U.S. District Court, District of Nevada, No. CV-S-04-1373-JCM-LRL, Oct. 25, 2004.
VendingData Corporation's Opposition to Shuffle Master Inc.'s Motion for Preliminary Injection for *Shuffle Master, Inc.* vs. *VendingData Corporation*, In the U.S. District Court, District of Nevada, No. CV-S-04-1373-JCM-LRL, Nov. 12, 2004.
VendingData Corporation's Responses to Shuffle Master, Inc.'s First set of interrogatories for *Shuffler Master, Inc.* vs. *VendingData Corporation*, in the U.S. District Court, District of Nevada, No. CV-S-04-1373-JCM-LRL, Mar. 14, 2005.
Shuffle Master, Inc. (1996). Let It Ride, The Tournament, User Guide, 72 pages.
U.S. Appl. No. 15/276,476, filed Sep. 26, 2016, titled "Devices, Systems, and Related Methods for Real-Time Monitoring and Display of Related Data for Casino Gaming Devices", to Nagaragatta et al., 36 pages.
U.S. Appl. No. 15/365,610, filed Nov. 30, 2016, titled "Card Handling Devices and Related Assemblies and Components", to Helsen et al., 62 pages.
Weisenfeld, Bernie; Inventor betting on shuffler; Courier-Post; Sep. 11, 1990; 1 page.
Solberg, Halvard; Deposition; *Shuffle Tech International* v. *Scientific Games Corp., et al.* 1:15-cv-3702 (N.D. III.) Oct. 18, 2016; pp. 187, 224-246, 326-330, 338-339, 396; Baytowne Reporting; Panama City, FL.
Prototype Glossary and Timelines; *Shuffle Tech International* v. *Scientific Games Corp., et al.* 1:15-cv-3702 (N.D. III.); undated; pp. 1-4.
Olsen, Eddie; Automatic Shuffler 'ready' for Atlantic City experiment; Blackjack Confidential; Jul./Aug. 1989; pp. 6-7.
Gros, Roger; New Card Management System to Be Tested at Bally's Park Place; Casino Journal; Apr. 1989; 5 pages.
Gola, Steve; Deposition; *Shuffle Tech International* v. *Scientific Games Corp., et al.* 1:15-cv-3702 (N.D. III.); Oct. 13, 2016; pp. 1, 9-21, 30-69, 150-167, 186-188, 228-231, 290-315, 411; Henderson Legal Services, Inc.; Washington, DC.

* cited by examiner

PLAYING CARD HANDLING DEVICES, SYSTEMS, AND METHODS FOR VERIFYING SETS OF CARDS

CROSS-REFERENCE TO RELATED APPLICATION

This application is a continuation of U.S. patent application Ser. No. 14/279,161, filed May 15, 2014, now U.S. Pat. No. 9,474,957, issued Oct. 25, 2016, the disclosure of which is hereby incorporated herein in its entirety by this reference.

TECHNICAL FIELD

The disclosure relates generally to playing card-handling devices and systems, such as shufflers, dealing shoes, and combinations thereof.

BACKGROUND

Games such as poker, baccarat, and blackjack use playing cards that have been randomized. Historically, playing cards were manually shuffled by a dealer or a player. Most casinos or other gaming establishments currently employ the use of mechanical automatic shufflers to randomize the cards. Automatic shufflers generally provide a higher level of randomization and security against cheating or mistakes compared to manual shuffling. However, players and dealers have been known to cheat or make mistakes that may lead to one or more improper or unauthorized cards being introduced into a set of cards used in a particular game. For example, cards from another set may be inadvertently mixed with a set of cards being used, or a cheating player may attempt to introduce a card that is advantageous to the cheating player into the set of cards being used. Thus, true randomization of the cards may be compromised and the cheating player may gain an advantage. Even if the unauthorized card is introduced into a set of cards by mistake, the fairness of the game may be reduced. Various security measures have been implemented to reduce the occurrence of such mistakes and cheating.

For example, prior known playing cards have been provided with enhanced security features. In one example, a transponder is positioned within the card body and is encoded with permanent read-only identification information as well as a data bank for receiving and maintaining changeable information transmitted thereto from an RF antenna, as described in U.S. Pat. No. 8,221,244, filed Nov. 14, 2008, titled "Table with Sensors and Smart Card Holder for Automated Gaming System and Gaming Cards" (hereinafter "the '244 patent"). The changeable information may include a transactional history of the card during a game, to reduce disputes regarding the history of a game and/or reduce various types of fraud and/or mistakes.

BRIEF SUMMARY

In some embodiments, the present disclosure includes systems for handling and verifying sets of cards. Such systems may include an automatic card shuffler and a shoe. The automatic card shuffler may include a card-shuffling mechanism configured to shuffle a set of cards, a shuffler processor programmed to randomly select a set symbol, and a printing device for applying the randomly selected set symbol to each card in the set of cards prior to removal of the set of cards from the automatic card shuffler. The shoe may include a receptacle for receiving the set of cards from the automatic card shuffler, a set symbol reader for reading each card of the set of cards for a presence and identity of a set symbol, and a shoe processor configured to receive a signal from the shuffler processor indicating the selected set symbol and configured to verify that each card of the set of cards includes a set symbol matching the selected set symbol.

In other embodiments, the present disclosure includes methods for verifying that cards to be removed from a card-handling device belong to a particular set of cards. In accordance with such methods, a randomly determined set symbol may be formed on each card in the particular set of cards with a first card-handling device. A signal representing the randomly determined set symbol may be transmitted with a data transmission device of the first card-handling device to a second card-handling device. The particular set of cards may be transferred from the first card-handling device to the second card-handling device. The methods may include detecting with the second card-handling device whether each card therein includes a set symbol matching the randomly determined set symbol. When a card does not include a set symbol matching the randomly determined set symbol, a signal may be provided indicating that a card does not belong to the particular set of cards.

In other embodiments, the present disclosure includes automatic card shufflers. Such automatic card shufflers may include a card infeed tray, a card-shuffling mechanism, and a card output tray. A processor may be programmed to randomly select a card set symbol to form on each card in a set of cards. The automatic card shufflers may include a card-marking system for forming the randomly selected set symbol on each card received in the card infeed tray prior to delivery of each card to the card output tray and a card-reading device for reading set symbols on cards delivered to the card output tray. The card-reading device may be in information communication with the processor, and the processor may be configured to generate a signal indicating a delivered card does not include a set symbol matching the randomly selected set symbol.

BRIEF DESCRIPTION OF THE DRAWINGS

While the disclosure concludes with claims particularly pointing out and distinctly claiming embodiments of the invention, various features and advantages of embodiments of the invention may be more readily ascertained from the following description when read in conjunction with the accompanying drawings, in which:

DETAILED DESCRIPTION

Figure 1:
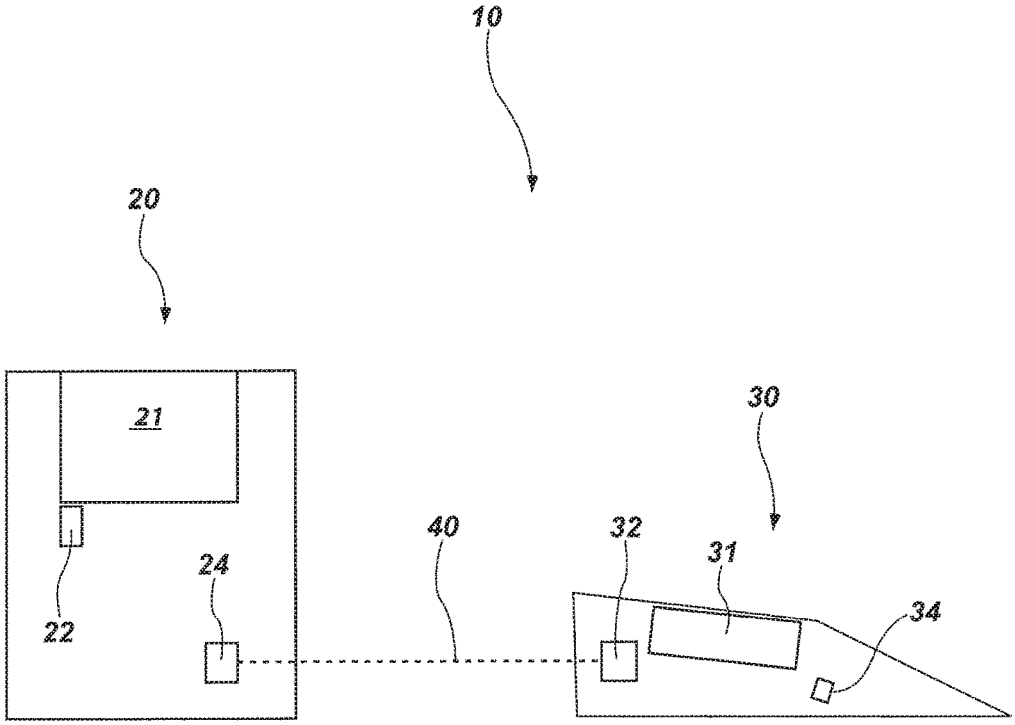
FIG. 1 is a simplified block diagram of a card-handling system according to an embodiment of the present disclosure.

The illustrations presented herein are not meant to be actual views of any particular system, device, or component thereof, but are merely idealized representations employed to describe illustrative embodiments. Thus, the drawings are not necessarily drawn to scale. Additionally, elements common between figures may retain the same or similar numerical designation.

As used herein, the term "invisible" in relation to ink or a symbol means imperceptible or unreadable to the unaided human eye. The visible spectrum is between about 390 nm and about 700 nm, which corresponds to a band of electromagnetic radiation between about 430 THz and about 790 THz for purposes of this disclosure. Invisible light is light outside of the visible spectrum. Invisible ink or an invisible symbol may be invisible to the human eye, but perceptible and readable to a reading device. An invisible symbol, for purposes of this disclosure, also includes symbols that are only perceptible to the human eye under magnification. In addition, an invisible symbol may appear to an unaided human eye as a visible line or other mark, but may include information, such as in the form of micro-script, that cannot be perceived or read by the unaided human eye.

As used herein, the term "printing" in relation to printing a symbol on a card means forming any identifier on or in the card. In some embodiments, printing may include applying a material, such as visible or invisible ink, wax, paint, or toner, to the card. In some embodiments, printing may include forming an identifier without any ink, such as by scratching the card, engraving the card, ablating material from the card, burning a portion of the card, embossing (i.e., forming a raised portion on) the card, sputtering, deposition, or debossing (i.e., forming indentations or recesses in) the card, for example.

As used herein, the phrase "card-handling device" means a mechanical or electromechanical device for handling cards. Non-limiting examples of card-handling devices include automatic card shufflers, card counters, card-dealing shoes, card storage devices, card verification devices, card-printing devices, card readers, and devices for performing any combination of functions thereof.

Embodiments of the present disclosure include systems including a first card-handling apparatus and a second card-handling apparatus. The first card-handling apparatus may be configured to print a randomly selected set symbol on each card of a set of cards. The set of cards may be transferred to the second card-handling apparatus, which may be configured to determine whether each of the cards therein includes a set symbol matching the randomly selected set symbol. The first and second card-handling apparatuses may be parts of a single device (e.g., a shuffling mechanism and an output tray), or may be separate devices (e.g., a card shuffler and a separate dealing shoe). In some embodiments, the shoe may be removably coupled to the shuffler or aligned with the shuffler such that cards may be automatically loaded into the shoe. If the first and second card-handling apparatuses are separate devices, a communication link may exist to enable the first card-handling apparatus to transmit a signal to the second card-handling apparatus indicating the randomly selected set symbol. The second card-handling device may receive the signal and compare the expected randomly selected set symbol with information (e.g., an image or other data) gathered from each card by a reading device. The systems of the present disclosure may provide improved security and fairness in playing card games by verifying that each card being dealt to players belongs to the proper set of cards. Thus, cheating or errors may be identified in which a card initially belonging to a different set is introduced into the set of cards being used.

As shown in FIG. 1, a card-handling system 10 of the present disclosure includes an automatic card shuffler 20 and a shoe 30. The automatic card shuffler 20 may be configured to shuffle (e.g., randomize) a set of cards with a card-shuffling mechanism 21. A printing device 22 may be configured to apply a randomly selected set symbol to each card in the set of cards prior to removal from the automatic card shuffler 20. A shuffler processor 24 may be configured (e.g., programmed) to randomly select a set symbol to be printed on each card of the set of cards with the printing device 22, for subsequent verification that each card belongs to the set of cards. Details of example embodiments suitable for use as the automatic card shuffler 20 and components thereof (e.g., the card-shuffling mechanism 21, the printing device 22, the processor 24) will be described below with reference to FIGS. 2, 3, 6, and 7.

The shoe 30 may include a receptacle 31 for receiving the set of cards from the automatic card shuffler 20 after the set of cards is shuffled and after the randomly selected set symbol is printed on each card of the set of cards by the printing device 22. The cards may be manually or automatically loaded. The shoe 30 may include a shoe processor 32 configured to receive a signal from the shuffler processor 24 indicating the randomly selected set symbol printed on each card of the set of cards, such as through a data connection 40. By way of example and not limitation, the data connection 40 may be a wireless connection, a hard wired connection, a data bus, a table system network, a local area network, a wide area network, a wireless network, or a cell phone network. The shoe 30 may also include a set symbol reader 34 for reading set symbols applied to each card of the set of cards. The shoe processor 32 may be configured to receive an image or other information from the set symbol reader 34 and to determine whether each card read by the set symbol reader 34 includes a set symbol matching the randomly selected set symbol. Accordingly, the shoe processor 32 may be configured to verify that each card belongs to the set of cards received from the automatic card shuffler 20 and to identify cards that do not belong to the set of cards (e.g., unauthorized cards inadvertently or purposely positioned within the receptacle 31). Details of example embodiments suitable for use as the shoe 30 and components thereof (e.g., the receptacle 31, the processor 32, the set symbol reader 34) will be described below with reference to FIGS. 4, 5, 6, and 7.

Figure 2:
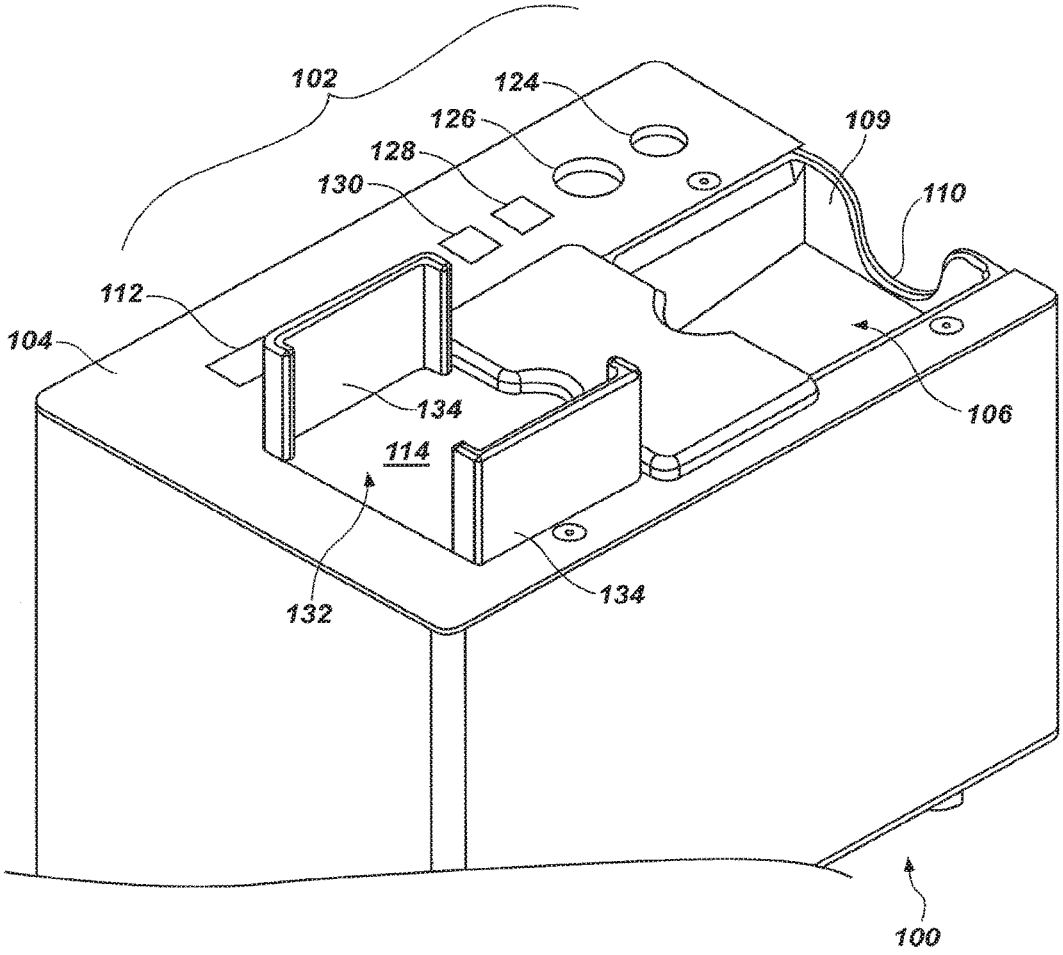
FIG. 2 is a partial perspective view of a card-handling device according to an embodiment of the present disclosure.

FIG. 2 is a partial perspective view of a card-handling device 100 according to an embodiment of the present disclosure, which may be used as the automatic card shuffler 20 of the card-handling system 10 of FIG. 1. The card-handling device 100 includes a card-receiving area 106 that may be provided with a stationary lower support surface that slopes downwardly from an outer side 109 of the card-handling device 100. The outer side 109 may include a depression 110 configured to facilitate an operator's ability to place or remove cards into the card-receiving area 106. A top surface 104 of a main body of the card-handling device 100 may include a user interface 102 that may include a visual display 112 (e.g., a light-emitting diode (LED), liquid crystal, micro monitor, or semiconductor display) and one or more user inputs 124, 126. The user inputs 124, 126 may include one or more buttons, touch screens, levers, knobs, etc. The user interface 102 may further include lights and/or displays 128, 130, which may be configured to indicate a power availability (on/off), a shuffler state (e.g., active shuffling, completed shuffling cycle, insufficient numbers of cards, missing cards, sufficient numbers of cards, complete deck(s), damaged or marked cards, entry functions for the dealer to identify the number of players, the number of cards per hand, access to fixed programming for various games, the number of decks being shuffled, card calibration information, etc.), or other information useful to the operator.

The card-handling device 100 may further include a shuffled card return area 132. The shuffled card return area 132 may include an elevator surface 114 and card-supporting sides 134 that surround at least a portion of the elevator surface 114. In some embodiments, the card-supporting sides 134 remain fixed to the elevator surface 114 during operation. In other embodiments, the card-supporting sides 134 may be fixed to the frame and do not move with the elevator surface 114. In some embodiments, the card-supporting sides 134 may be removable. Removal of the card-supporting sides 134 may enable the operator to lift a shuffled set of cards onto a gaming table surface or to carry a shuffled set of cards to a dealing shoe for use in a card game. In some embodiments, the card-supporting sides 134 may act as a cassette for carrying the shuffled cards to a location remote from the card-handling device 100. Additional details regarding such a card-handling device are described in U.S. Pat. No. 7,764,836, issued Jul. 27, 2010, and entitled "Card Shuffler with Card Rank and Value Reading Capability Using CMOS Sensor," the disclosure of which is incorporated herein in its entirety by this reference. Internally, the card-handling device 100 may further include a processor 152 (FIG. 3) configured in hardware and/or software for randomly selecting a symbol to be printed on a set of cards and a printing device 150 (FIG. 3) for printing the randomly selected symbol on each card of the set, as will be described in further detail below.

Figure 3:
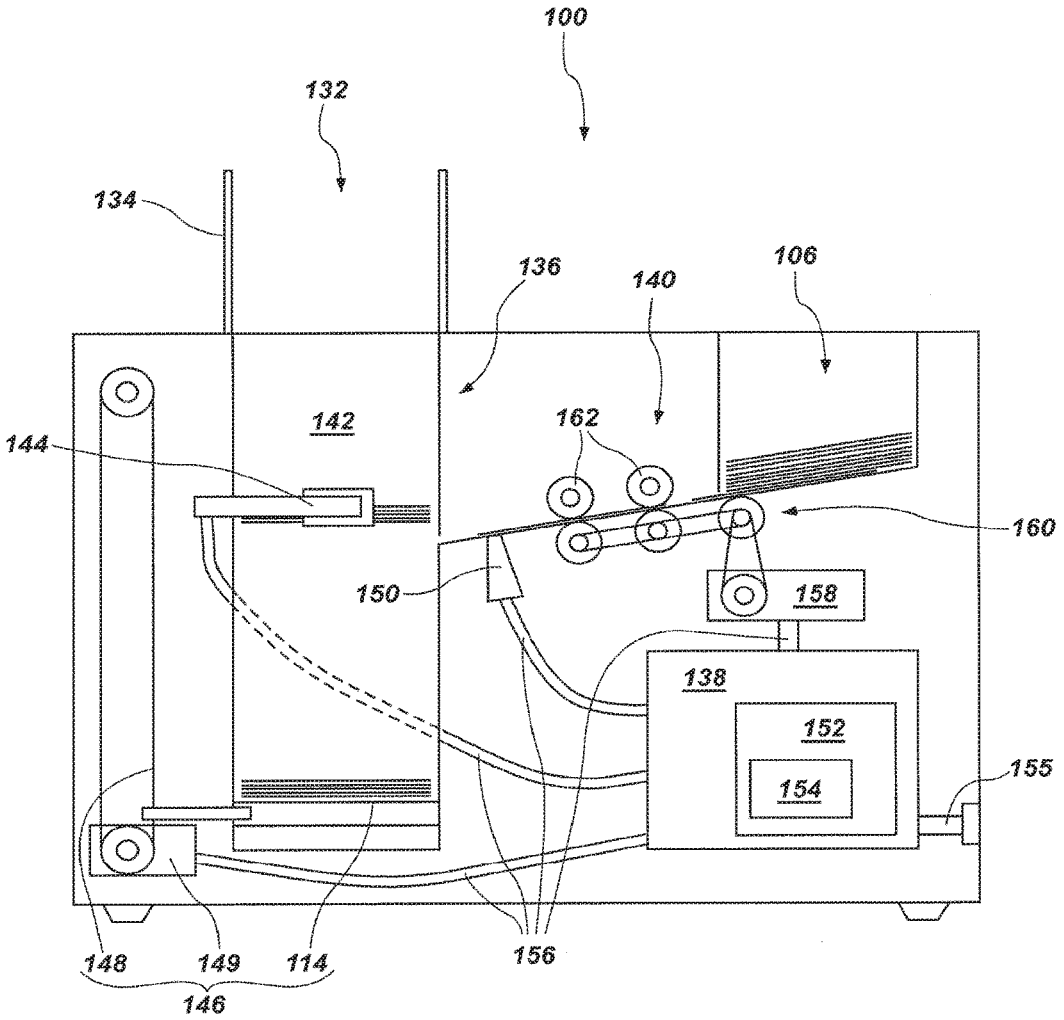
FIG. 3 is a simplified side view of internal components of the card-handling device of FIG. 2.

FIG. 3 illustrates a simplified view of internal components of the card-handling device 100 of FIG. 2. The card-handling device 100 shown in FIG. 3 and described herein is an automatic card shuffler 100, although embodiments of the present disclosure may be implemented in other card-handling devices, such as card verification devices. The automatic card shuffler 100 may include a shuffling mechanism 136, an electrical control unit 138, a card-moving mechanism 140, and a marking or printing device 150. By way of example and not limitation, the shuffling mechanism 136 may include a shuffling chamber 142, one or more grippers 144, and an elevator 146. The elevator 146 may include the elevator surface 114, an elevator belt 148, and an elevator motor 149. At least one processor 152 of the electrical control unit 138 may include a random number generator (RNG) 154. The RNG 154 may be implemented in hardware and/or software. In other embodiments, the RNG 154 may be separate from the at least one processor 152. The at least one processor 152 may be configured to process inputs and data and to control the various components of the automatic card shuffler 100. A data connection 155 (e.g., a data line, a wired transmission line or device, a wireless transmission device) may be configured to transmit data (e.g., the identity of a randomly selected set symbol) from the automatic card shuffler 100 to another card-handling device, such as a dealing shoe 200 described below with reference to FIGS. 4 and 5, for example. The electrical control unit 138 may be configured to control the shuffling mechanism 136, the card-moving mechanism 140, and the printing device 150, such as by sending electrical signals to such components through wires 156. The card-moving mechanism 140 may include a roller motor 158, lower powered rollers 160, and upper unpowered rollers 162.

During operation, each card may have a randomly selected set symbol applied (e.g., printed) thereon by the printing device 150. The randomly selected set symbol may be selected using the RNG 154 of the electrical control unit 138 prior to a first card of the set of cards being moved into the shuffling mechanism 136. The printing device 150 may print the same randomly selected set symbol on each card of the set of cards, such that every card of a particular set of cards handled by the automatic card shuffler 100 has the same randomly selected set symbol printed thereon. When a new set of cards is positioned within the card-receiving area 106 to be randomized by the automatic card shuffler 100, a new set symbol may be randomly selected to be printed on each card of the new set of cards. Thus, the randomly selected set symbol may provide a random and unique identifier for each set of cards randomized by the automatic card shuffler 100.

Any symbol that is capable of being printed on the cards and uniquely recognized by a reading device may be used as the randomly selected set symbol. For example, the randomly selected set symbol to be printed on each card of the set of cards may include one or more of the following: a random sequence of numbers; a random sequence of letters; a random sequence of special characters, such as punctuation marks, mathematical symbols, and other symbols including "~," "@," "#," "$," "%," "^," "&," and "*," for example; a random bar code; a random dot matrix code; a random pictograph or sequence of pictographs; and a random sequence of foreign language symbols (e.g., Asian language characters, Greek language letters, Arabic language symbols, combinations thereof). Any randomly selected symbol capable of application onto each card in the set and then symbol reading by a reader 202 (FIGS. 4 and 5) is suitable for use with embodiments of the present disclosure.

The printing device 150 may include any device capable of printing the randomly selected set symbol on cards. By way of example and not limitation, the printing device 150 may be similar or identical to printing devices used to print expiration dates on food or beverage containers. By way of further example, the printing device 150 may be or include a bar code printer, a dot matrix printer, an ink jet printer, a laser printer, an embosser, a debosser, a scratching device, a laser ablation device, a stamp, a nano-marking device, or any of the print heads described in U.S. Pat. No. 7,390,256, filed Dec. 13, 2001, titled "Method, Apparatus and Article for Random Sequence Generation and Playing Card Distribution," the disclosure of which is incorporated herein in its entirety by this reference. In another example, the printing device 150 may be positioned and configured to print a bar code along side edges of the cards when the cards are positioned in a stack, such as an initial stack of cards in the card-receiving area 106 or a randomized stack of cards in the shuffling mechanism 136. The printing device 150 may be configured to apply visible ink, invisible ink, or no ink to the card. If no ink is used, the printing device 150 may be configured to print the selected set symbol on the cards by removing material of the card, such as by scratching the card, engraving the card, or ablating material (e.g., a polymer or wax coating) from the card, by burning a portion of the card, by embossing (i.e., forming raised portions on) the card, or by debossing (i.e., forming indentations or recesses in) the card, for example.

In some embodiments, the card-moving mechanism 140 may be stopped when a card is in a position for printing the selected set symbol thereon by the printing device 150. In other embodiments, the printing device 150 may be configured to print the selected symbol on the card while the card is moving from the card-receiving area 106 toward the shuffling mechanism 136.

To randomize the set of cards, the RNG 154 (or another RNG) may select a random number of cards to be suspended by the one or more grippers 144, the random number selected from the set of numbers between and including zero and the number of cards present within the shuffling chamber 142. The elevator surface 114 may be raised to an appropriate level to position the random number of cards at the level of the one or more grippers 144. Next, the one or more grippers 144 may grip and suspend the random number of the cards in the shuffling chamber 142, after which the elevator surface 114 with or without cards thereon may be lowered to form a gap below the cards suspended by the one or more grippers 144. A card from the card-receiving area 106 and including the selected set symbol printed thereon may be inserted into the gap, the elevator surface 114 raised, and the one or more grippers 144 may be released to enable the previously suspended cards to be supported by the elevator surface 114. To continue the randomization of the set of cards, the elevator position may be moved to another random location, and the one or more grippers 144 may again grip and suspend another random number of cards to form another gap, and another card may be inserted into the newly formed gap. Such operations may be repeated until every card initially present in the card-receiving area 106 has been randomly positioned within the shuffling chamber 142. The randomized set of cards stacked on the elevator surface 114 may then be raised by the elevator 146 to the shuffled card return area 132 for removal from the automatic card shuffler 100.

As noted above, the cards may or may not be stopped to enable the printing device 150 to print the randomly selected set symbol on each card. In some embodiments, the time it takes to print the randomly selected set symbol may be about the same time or less time compared to the time it takes to form a new gap in the shuffling mechanism 136 for insertion of the card being printed. Accordingly, operation of the printing device 150 may have little, if any, impact on the overall operation speed of the automatic card shuffler 100. In other embodiments, such as when the selected printing device 150 operates relatively slower than the shuffling mechanism 136, the printing may lengthen the time the automatic card shuffler 100 can produce a randomized set of cards. However, the benefits of added security (discussed in more detail below) enabled by the presence of the randomly selected set symbol on each of the cards may outweigh any drawback of additional processing time. In some embodiments, the user interface 102 (FIG. 2) may include an input for disabling the printing device 150, such as when the benefits of randomization speed outweigh the benefits of printing a randomly selected set symbol on cards to be randomized or when the automatic card shuffler 100 is to be used simply to randomize a set of cards.

Although FIG. 3 has been described as including a particular shuffling mechanism 136 that includes one or more grippers 144 and an elevator 146, other shuffling mechanisms may be used in embodiments of the present disclosure. For example, the printing device 150 may be used to print a randomly selected set symbol on cards being shuffled by any of a riffling mechanism, a circular carousel of slots, a linear stack of slots, a random ejection unit, and any other known shuffling mechanism. Accordingly, the present disclosure is not limited by the specific configuration or type of shuffling mechanism used. In addition, the printing device 150 may be positioned within the automatic card shuffler 100 relative to the shuffling mechanism 136 to print a randomly selected set symbol on cards prior to the cards entering the shuffling mechanism 136, while the cards are within the shuffling mechanism 136, or after the cards are removed from the shuffling mechanism 136. Such options for positioning the printing device 150 may be selected by one of ordinary skill in the art given the type and configuration of the particular shuffling mechanism used and based upon space and/or design constraints of the automatic card shuffler 100 in general.

Figure 4:
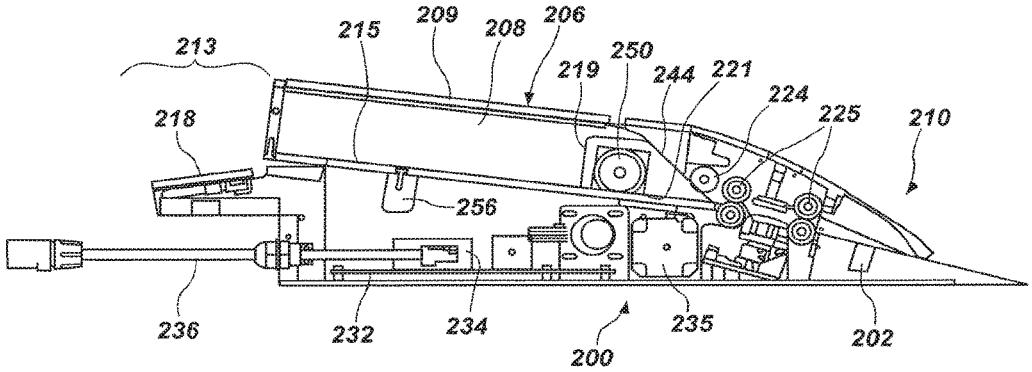
FIG. 4 is a cross-sectional side view of a dealing shoe according to an embodiment of the present disclosure.

FIG. 4 shows a cross-sectional side view of a dealing shoe 200 of the present disclosure, which may be used as the shoe 30 of the card-handling system 10 of FIG. 1. The dealing shoe 200 may be positioned at a playing table or other location where a card game is to be played. The dealing shoe 200 may be configured to receive a set of randomized cards from the automatic card shuffler 100 described above. The dealing shoe 200 may also be configured to receive a signal from the automatic card shuffler 100 indicating a selected set symbol that has been printed on each card of the set of randomized cards. For example, a wired data line 236 may be used to receive such a signal from the automatic card shuffler 100 or a wireless data connection may be used. The dealing shoe 200 may include a set symbol reader 202 configured to read a symbol on each card for comparison with the selected set symbol transmitted to the dealing shoe 200. Accordingly, the dealing shoe 200 may verify that each card dealt or to be dealt from the dealing shoe 200 belongs to the set of cards received from the automatic card shuffler 100. If any card does not include a set symbol that matches the selected set symbol, then the dealing shoe 200 may indicate the presence of the improper card and/or cease allowing cards to be removed from the dealing shoe 200, or the processor 234 associated with the dealing shoe 200 may generate an error signal. The error signal may, for example, be displayed on an input and display panel 218 or may be transmitted to another device, such as a control room server.

The dealing shoe 200 may be configured to receive a cartridge 206 of previously randomized cards from the automatic card shuffler 100 described above. In some embodiments, the cartridge 206 may be removable from the dealing shoe 200. For example, the card-supporting sides 134 of the automatic card shuffler 100 (FIGS. 2 and 3) may be in the form of the cartridge 206, and cards may be inserted into an internal chamber 208 of the cartridge 206 directly by the automatic card shuffler 100. In other embodiments, cards may be transferred by a person from the shuffled card return area 132 of the automatic shuffler 100 into the internal chamber 208 of the cartridge 206. In some embodiments, the cartridge 206 may be an integral portion of the dealing shoe 200 and may not be removable from the dealing shoe 200, and cards may be moved from the automatic card shuffler 100 and placed in the internal chamber 208 of the cartridge 206 for dealing from the dealing shoe 200. A removable lid 209 of the cartridge 206 may be removed to enable access to the internal chamber 208 for loading the dealing shoe 200 with cards or to otherwise provide access to the cards in the dealing shoe 200.

A movable weight 219 may be positioned within the cartridge 206 for pressing cards therein against an angled front surface 244 of the cartridge 206 and against at least one card-moving roller 224 of the dealing shoe 200, to enable the at least one card-moving roller 224 to contact a card and, by rotating responsive to operation of a motor 235, move the contacted card toward a card-dealing end 210 of the dealing shoe 200. A wheel 250 may be coupled to the movable weight 219 to reduce friction between a lower surface 215 of the cartridge 206 and a lower surface 221 of the weight 219 as the movable weight 219 moves along the lower surface 215. A stabilizing foot 256 on the cartridge 206 may align and stabilize the cartridge 206 relative to the dealing shoe 200 when positioned on the dealing shoe 200.

The input and display panel 218 may be positioned at an end 213 of the dealing shoe 200 opposite the card-dealing end 210. The input and display panel 218 may include inputs, such as inputs for identifying a card game to be played, commencing dealing of cards, stopping dealing of cards, resolving errors, etc. The input and display panel 218 may also be configured to display information to the dealer. For example, an indicator that a card does not include a set symbol that matches the selected set symbol may be displayed on the input and display panel 218. Such inputs and display elements (e.g., indicators) of the input and display panel 218 may be implemented in hardware, such as using buttons, lights, etc., or in software, such as using a touch screen that displays different inputs and display elements during operation. Additionally or alternatively, other indicators may include a visual display, an audible alarm, and a locking device configured to prevent cards from being removed after a card without the selected set symbol is detected by the dealing shoe 200.

The dealing shoe 200 may also include a circuit board 232, which includes a processor 234, for controlling and providing electrical power to various elements of the dealing shoe 200. For example, the processor 234 may control the presentation of cards at the card-dealing end 210 for removal, movement of cards by controlling the motor 235 and/or the card-moving rollers 224, 225, receipt of signals from an external source to identify a randomly selected set symbol, determination of whether cards include a set symbol matching the randomly selected set symbol by controlling the set symbol reader 202 and comparing read symbols with the expected randomly selected set symbol, indication of whether a card is detected that does not include a set symbol matching the randomly selected set symbol, receipt of commands from the input and display panel 218, display of information at the input and display panel 218, etc.

Figure 5:
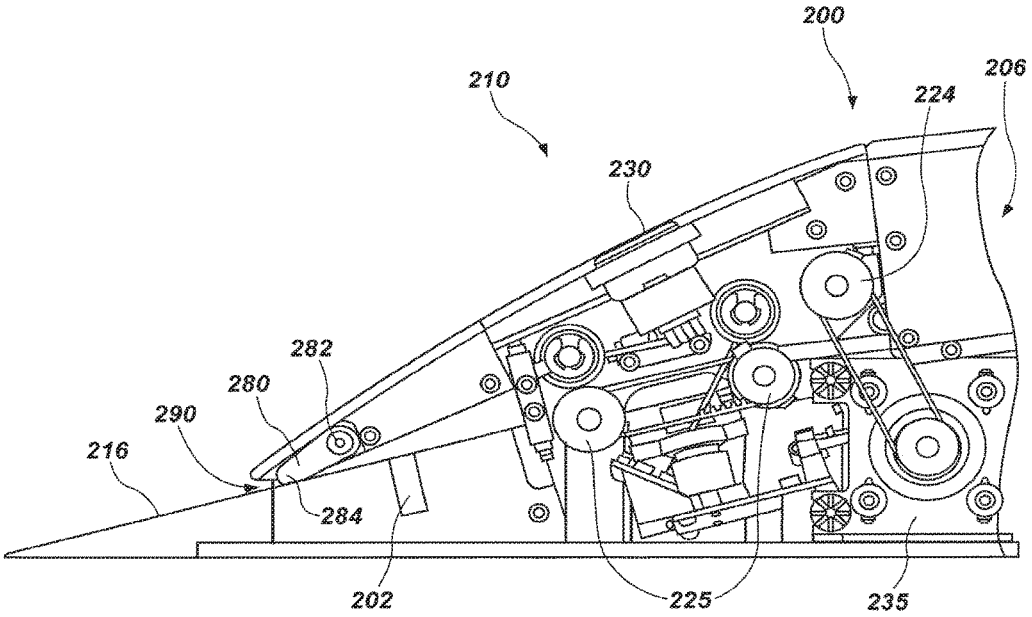
FIG. 5 is a cross-sectional side view of a card-dealing end of the dealing shoe of FIG. 4.

FIG. 5 illustrates the card-dealing end 210 of the dealing shoe 200 of FIG. 4 in greater detail. Referring to FIG. 5 in conjunction with FIG. 4, an activation button 230 may be used to initiate card dealing after a new cartridge 206 has been inserted into a cartridge receiving area of dealing shoe 200. The motor 235 may cause the one or more card-moving rollers 224 to rotate, resulting in movement of a card from the cartridge 206 toward one or more additional card-moving rollers 225 and toward a position from which the card may be removed from the dealing shoe 200, such as along a terminal surface 216 of the card-dealing end 210.

The card-dealing end 210 may include a set symbol reader 202, which may be configured to read each card and communicate with the processor 234 to determine whether each card includes a set symbol and that the set symbol matches the randomly selected set symbol identified by receiving a signal from the automatic card shuffler 100. As used herein, the phrase "matching the randomly selected set symbol" and related phrases mean that the expected set symbol is present on the card and no other unexpected set symbols are present on the card. Of course, if a card does not include any set symbol, then the card does not include a set symbol matching the randomly selected set symbol. In addition, if a card includes a set symbol different from the randomly selected set symbol, then the card does not include a set symbol matching the randomly selected set symbol. Furthermore, in some embodiments, if a card includes the randomly selected set symbol printed over or in addition to another unexpected symbol, then the card does not include a set symbol matching the randomly selected set symbol. Accordingly, even a card originally from another set of cards that previously received a first set symbol and that has the expected randomly selected set symbol printed over or in addition to the first set symbol may be identified as a card that does not properly belong to the set of cards.

The set symbol reader 202 may be any device that is capable of perceiving an invisible or visible symbol printed on each card in sufficient detail to determine if the card includes the expected set symbol. Accordingly, the set symbol reader 202 may include at least one magnifying lens, an imaging device (e.g., a camera), a light source (e.g., an ultraviolet light source, a laser source, a visible light source) for revealing or reading the symbol, and/or any other component or device configured to enable the set symbol reader 202 to perceive the particular set symbol printed on each card.

A toggle weight 280 that pivots about axis pin 282 may be positioned at the card-dealing end 210 of the dealing shoe 200. A front end 284 of the toggle weight 280 may be blunt or flattened to prevent any playing cards from being reinserted into opening 290 of the delivery shoe 200. The toggle weight 280 may also inhibit individual cards from inadvertently slipping out of the dealing shoe 200, and thus may define a stopping position for cards moved toward the opening 290. In some embodiments, the toggle weight 280 may be a component of a locking device of the dealing shoe 200, the locking device configured to hold the toggle weight 280 in a closed position (as shown in FIG. 5) when a card is identified that does not include a set symbol matching the expected randomly selected set symbol thereon. Thus, if the processor 234 determines that an improper card is present, one or more cards may be prevented from removal from the dealing shoe 200 by the locking device. In some embodiments, the toggle weight 280 may be automatically moved by a stepper motor controlled by the processor 234 from an open position (not shown) to a closed position (FIG. 5) and functions as a locking device. In other examples, the locking device may be implemented as a gate that is moved into a position to block the opening 290, or as the card-moving roller 224 and/or the one or more additional card-moving rollers 225 ceasing movement of cards toward the opening 290.

Accordingly, the present disclosure includes systems including an automatic card shuffler that randomly determines and prints a selected set symbol on every card of a set being shuffled. The systems also include a dealing shoe equipped with a set symbol reader for verifying that each card being dealt by the dealing shoe belongs to the set shuffled by the automatic card shuffler. Thus, embodiments of the present disclosure may enhance security, reduce errors caused by introduction of improper cards into the set of cards, and increase fairness of playing card games. The cost of these benefits may be somewhat lower than purchasing cards from card manufacturers that include enhanced security features, since any card that can be shuffled by the automatic card shuffler (including cards lacking any enhanced security feature) may be printed with a randomly selected set symbol. The random selection of the set symbol may further enhance security, since any person who attempts to cheat by introducing a card from another set of cards will be unlikely to predict or guess the randomly selected set symbol of a particular set of cards.

Figure 6:
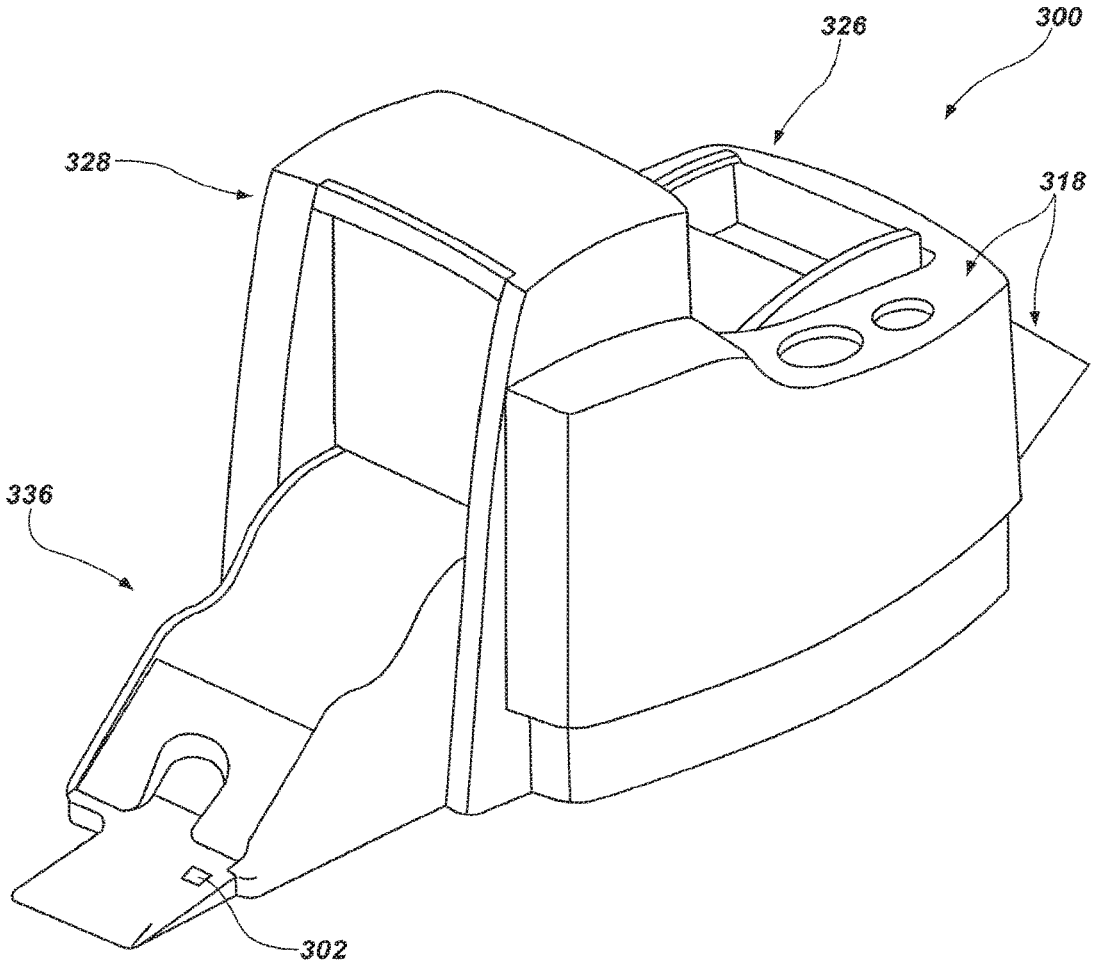
FIG. 6 is a perspective view of an automatic card shuffler according to an embodiment of the present disclosure.

FIG. 6 illustrates an automatic card shuffler 300 that includes a card infeed tray 326 for receiving a set of cards to be randomized, a card-shuffling mechanism 328, and a card output tray 336. The automatic card shuffler 300 may also include inputs and displays 318 similar in function to the input and display panel 218 described above with reference to FIGS. 4 and 5. The card output tray 336 may include a card-reading device 302 similar to the set symbol reader 202 described above with reference to FIGS. 4 and 5. Cards positioned within the card infeed tray 326 may be moved into the card-shuffling mechanism 328 and then into the card output tray 336 in a random order (compared to an order of the cards positioned within the card infeed tray 326). In addition, a randomly selected set symbol may be printed on each card by the automatic card shuffler 300, and the card-reading device 302 may verify that each card includes a set symbol matching the randomly selected set symbol, as described in more detail below.

Figure 7:
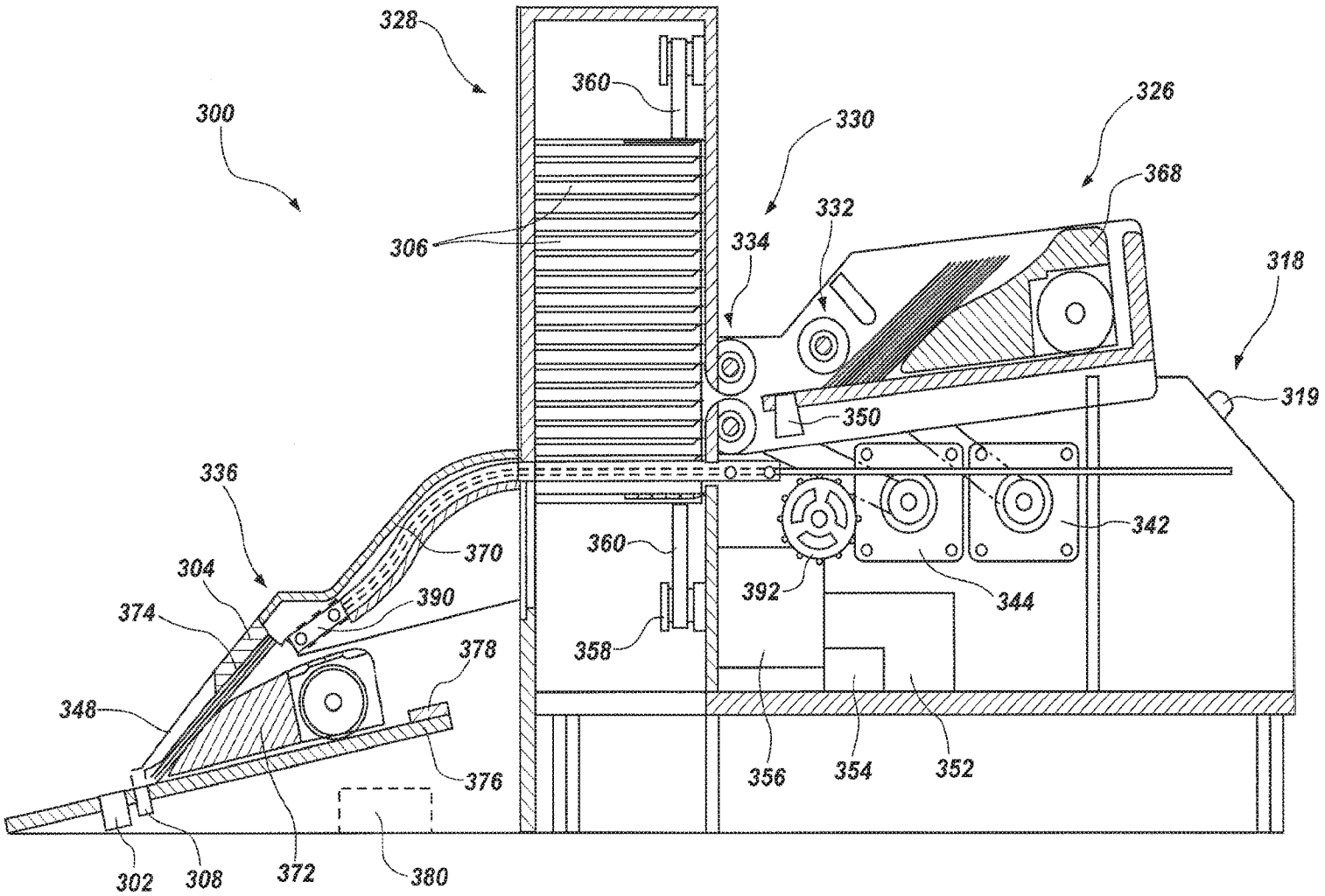
FIG. 7 is a simplified side view of internal components of the automatic card shuffler of FIG. 6.

Referring to FIG. 7, additional components of the automatic card shuffler 300 include a printing device 350 for printing a randomly selected set symbol on each card of a set of cards to be shuffled, a processor 352 configured (e.g., programmed) to control various other components of the automatic card shuffler 300, a card-moving mechanism 330 for moving cards from the card infeed tray 326 into the card-shuffling mechanism 328, a plurality of compartments 306 arranged in a vertical stack in the card-shuffling mechanism 328, and a pusher 390 for pushing cards from the card-shuffling mechanism 328 into the card output tray 336.

The printing device 350 may be similar in structure and function to the printing device 150 described above with reference to FIG. 3. The printing device 350 may be positioned to enable the printing device 350 to print a randomly selected set symbol on each card as each card is moved from the card infeed tray 326 into the card-shuffling mechanism 328 by the card-moving mechanism 330. The processor 352 may be configured (e.g., programmed) to randomly select a set symbol to be printed on each card of a set of cards by the printing device 350, such as by using a random number generator (RNG) 354 (implemented in hardware or software). The set symbol to be printed on each card of a set of cards by the printing device 350 may be randomly selected when a shuffling cycle is commenced, such as responsive to a dealer positioning a set of cards in the card infeed tray 326 and/or interacting with the inputs and displays 318. The processor 352 may also be configured (e.g., programmed) to control the card-shuffling mechanism 328, such as by selecting a random compartment 306 to receive each card, up to a maximum number of cards that can fit into each compartment 306.

The card-shuffling mechanism 328 may include an elevator motor 356 controlled by the processor 352 for moving the compartments 306 into position to receive one or more cards from the card infeed tray 326 and into position to remove cards from the compartments 306 into the card output tray 336. For example, the elevator motor 356 may be configured to rotate an elevator roller 358 coupled to an elevator belt 360. The compartments 306 may be coupled to the elevator belt 360 such that movement of the elevator belt 360 by rotation of the elevator roller 358 causes the compartments 306 to move vertically.

The card-moving mechanism 330 may include a first roller 332 and second rollers 334. The first roller 332 may be positioned to contact a card of the set of cards in the card infeed tray 326 urged toward the first roller 332 by an infeed block 368 similar to the movable weight 219 described above with reference to FIG. 4. A first roller motor 342 controlled by the processor 352 may be operatively coupled to the first roller 332 to cause the first roller 332 to rotate to move a leading card from the set of cards over the printing device 350 and toward the card-shuffling mechanism 328. Similarly, the second rollers 334 may be operatively coupled to a second roller motor 344 controlled by the processor 352. Optionally, the second rollers 334 may be configured to stop each card over the printing device 350 for a sufficient time to print a randomly selected symbol on each card at a predetermined location on the card. Before each card is moved by the second rollers 334 into a respective compartment 306, the processor 352 may cause the elevator motor 356 to move a randomly selected compartment 306 into a position to receive the card.

Each of the compartments 306 may be sized to receive one or more cards therein. In some embodiments, each compartment 306 may be capable of receiving a full or a partial hand of cards for a game to be played. For example, if the game to be played using the set of cards randomized by the automatic card shuffler 300 is five-card poker, each compartment 306 may be sized to provide space for five cards. In other embodiments, each compartment 306 may be sized to provide space for one, two, three, four, five, six, or seven cards. One of the compartments 306 may be a discard compartment sized to receive more cards than a single hand of cards for the game to be played.

A pusher 390 may be configured to push one or more cards out of each compartment 306 and into the card output tray 336. By way of example and not limitation, the pusher 390 may include an elongated flexible member configured to be extended and retracted by a pusher motor using a toothed gear 392. After all cards of the set of cards initially positioned within the card infeed tray 326 are randomly positioned within respective compartments 306, cards within the compartments 306 may be moved into the card output tray 336 by the pusher 390. The elevator motor 356 may respectively position each compartment 306 in a location aligned with a card way 370 to enable the pusher 390 to push the one or more cards out of each compartment 306 as a group. Upon being pushed out of the compartment(s) 306, the card(s) may travel through the card way 370 and may then be positioned between an output block 372 and the terminal end plate 304 for removal from the card output tray 336. The output block 372 may be similar to the infeed block 368 and may be used to push the card(s) against the terminal end plate 304. An inverted U-shaped opening 348 in the terminal end plate 304 may enable a top front card within the card output tray 336 to be contacted by a finger of a dealer such that the dealer may remove the top card from the card output tray 336.

As additional cards are pushed by the pusher 390 toward the terminal end plate 304, the additional cards may be positioned between the output block 372 and any cards 374 already delivered and/or the terminal end plate 304, urging the output block 372 to slide up an angled floor 376 to provide space for the additional cards. The output block 372 may be able to slide up the angled floor 376 until the output block 372 reaches a stop 378 positioned to limit movement of the output block 372. However, in other embodiments, the stop 378 may be omitted and the output block 372 may be free to slide up the angled floor 376 until the output block 372 comes to rest against another feature of the automatic card shuffler 300, such as a wall of the card-shuffling mechanism 328. Accordingly, the card output tray 336 may be configured to hold any number of cards ready for removal, such as from one card up to a number of cards of the entire set of cards to be randomized by the automatic card shuffler 300 (e.g., 52 cards if a 52-card deck is used as the set of cards). In some embodiments, cards delivered to the card output tray 336 at any given time may form a partial or a full hand of cards for a selected game. In other embodiments, a small number of cards, such as 12 or fewer cards, may be present in the card output tray 336 at any given time.

The card-reading device 302 may be configured to read at least a set symbol on each card delivered to the card output tray 336, such as when each card is removed from the card output tray 336. The card-reading device 302 may be in information communication with the processor 352. Thus, the processor 352 may be configured (e.g., programmed) to compare an image of a card surface or other information (e.g., a sequence of numbers, letters, or other symbols) received from the card-reading device 302 with the expected randomly selected set symbol.

The card-reading device 302 may be positioned and configured to read each card upon removal from the card output tray 336. Information read may be communicated to the processor 352, which may determine whether the card being read includes a set symbol matching the randomly selected set symbol, to determine whether the card belongs to the set of cards initially positioned within the card infeed tray 326. Thus, tampering or errors may be detected, such as one or more cards being purposely or inadvertently left in the compartments 306 during a game previously played using the automatic card shuffler 300. In addition, an unauthorized card inserted into the set of cards in the card infeed tray 326 from a different set of cards and having a different set symbol (e.g., a card retained by a player from a previous game using the automatic card shuffler 300) may be detected due to the randomly selected set symbol being superimposed over a previous set symbol or a previous set symbol being additionally printed on the card.

In some embodiments, the card output tray 336 may be detachable from the card infeed tray 326 and the card-shuffling mechanism 328 of the automatic card shuffler 300. Accordingly, the card output tray 336 may be implemented as a dealing shoe that is dockable and removably attached to the card-shuffling mechanism 328. In such embodiments, each card of a set of cards positioned in the card infeed tray 326 may receive a randomly selected set symbol from the printing device 350, and the set of cards may be randomized by the card-shuffling mechanism 328, as described above. Then, all cards may be moved from the card-shuffling mechanism 328 to the card output tray 336. The output block 372, angled floor 376, and stop 378 (if present), may be configured and sized to hold an entire set of cards. After all cards are moved from the shuffling mechanism 328 to the card output tray 336, the card output tray 336 may be detached from the card-shuffling mechanism 328 and moved to a location for dealing the cards in a card game, such as to a gaming table. By way of example, a suitable quick coupling mechanism is described in U.S. Pat. RE42,944, titled "Card Shuffling Device," reissued on Nov. 22, 2011, the entire disclosure of which is incorporated by reference herein. The card-reading device 302 may be configured to detect any card from another set of cards (i.e., other than the set of cards positioned in the card output tray 336 by the automatic card shuffler 300) introduced into the card output tray 336 without authorization, such as a card introduced through the card way 370 during transport of the card output tray 336 to a gaming table.

In embodiments in which the card output tray 336 is detachable, the card output tray 336 may include another processor 380 (shown in FIG. 7 in phantom lines) in communication with the card-reading device 302, the another processor 380 being configured (e.g., programmed) to receive images or other information from the card-reading device 302 and to determine whether each card includes a set symbol matching the randomly selected set symbol. The another processor 380 may, at least when the card output tray 336 is attached to the card-shuffling mechanism 328 and the card infeed tray 326, be in information communication with the processor 352 of the automatic card shuffler 300. Thus, the another processor 380 of the card output tray 336 may receive an indication from the processor 352 of the automatic card shuffler 300 identifying the randomly selected set symbol of the set of cards moved from the card-shuffling mechanism 328 into the card output tray 336 for comparison with images or other information received from the card-reading device 302. A data connection for providing the information communication between the processor 352 of the automatic card shuffler 300 and the another processor 380 of the card output tray 336 may be provided by one or more of a wireless connection, a hard wired connection, a data bus, a table system network, a local area network, a wide area network, a wireless network, and a cell phone network.

If it is determined by the card-reading device 302 and processor 352 (or the processor 380) that a card does not include a set symbol matching the randomly selected set symbol, the automatic card shuffler 300 may provide an indication of the error. The indication of the error may be associated with the card output tray 336 (e.g., in an embodiment employing a detachable card output tray 336) and/or with the inputs and displays 318. For example, in some embodiments, an indicator light 319 may provide a visual indication that a card read by the card-reading device 302 does not belong to the expected set of cards. The inputs and displays 318 may include a display screen that provides a visual display indicating the error. An audible alarm may alternatively or additionally sound to indicate the error. By way of another example, the automatic card shuffler 300 may include a locking device, such as in the form of a card stop 308, configured to prevent additional cards from being removed from the card output tray 336 after a card is drawn bearing a set symbol that does not match the selected set symbol or lacking the selected set symbol. In such an embodiment, the card stop 308 may be configured to move between an open position (shown in FIG. 7 in solid lines) allowing cards to be removed from the card output tray 336 and a closed position (shown in FIG. 7 in phantom lines) preventing cards from being removed from the card output tray 336. An example of a suitable card stop is a solenoid-actuated cylinder that blocks the card path in a first position and is free of the card path in a second position. A locking device may also be implemented by the pusher 390 and pusher motor being configured to cease moving cards from the card-shuffling mechanism 328 to the card output tray 336 when a card is detected that does not include a set symbol matching the selected set symbol.

As explained above, the automatic card shuffler 300 may provide improved security, confidence, and fairness in games using playing cards. Such benefits may be accomplished without the necessity of purchasing expensive cards with enhanced security features. The automatic card shuffler 300 may also discourage individuals from cheating or making errors in the transportation and handling of cards.

Additional, non-limiting example embodiments of the present disclosure are set forth below.

Embodiment 1

A system for handling and verifying sets of cards, the system comprising: an automatic card shuffler, comprising: a card-shuffling mechanism configured to shuffle a set of cards; a shuffler processor programmed to randomly select a set symbol; and a printing device for applying the randomly selected set symbol to each card in the set of cards prior to removal of the set of cards from the shuffler; and a shoe comprising: a receptacle for receiving the set of cards from the automatic card shuffler; a set symbol reader for reading each card of the set of cards for a presence and identity of a set symbol; and a shoe processor configured to receive a signal from the shuffler processor indicating the selected set symbol and configured to verify that each card of the set of cards includes a set symbol matching the selected set symbol.

Embodiment 2

The system of Embodiment 1, further comprising a data connection between the shuffler processor and the shoe processor for transmitting the signal indicating the selected set symbol.

Embodiment 3

The system of Embodiment 2, wherein the data connection is selected from the group consisting of: a wireless connection, a hard wired connection, a data bus, a table system network, a local area network, a wide area network, a wireless network, and a cell phone network.

Embodiment 4

The system of any one of Embodiments 1 through 3, wherein the shoe further comprises an indicator configured to indicate when a card of the set of cards does not include the selected set symbol.

Embodiment 5

The system of Embodiment 4, wherein the indicator is selected from the group consisting of a visual display, an audible alarm, and a locking device of the shoe configured to prevent cards from being removed from the shoe after a card without the selected set symbol is detected by the shoe.

Embodiment 6

The system of any one of Embodiments 1 through 5, wherein the shoe further comprises a locking device configured to prevent a card marked with a set symbol that does not match the selected set symbol or a card lacking the selected set symbol from being removed from the shoe.

Embodiment 7

The system of any one of Embodiments 1 through 6, wherein the shoe further comprises a locking device configured to prevent additional cards from being removed from the shoe after a card is drawn bearing a set symbol that does not match the selected set symbol or lacking the selected set symbol.

Embodiment 8

The system of any one of Embodiments 1 through 7, wherein the printing device is selected from the group consisting of a bar code printer, a dot matrix printer, an ink jet printer, a laser printer, an embosser, a debosser, a scratching device, a laser ablation device, a stamp, and a nanomarking device.

Embodiment 9

The system of any one of Embodiments 1 through 7, wherein the printing device is selected from the group consisting of an embosser, a debosser, a scratching device, and a laser ablation device.

Embodiment 10

A method of verifying that cards to be removed from a card-handling device belong to a particular set of cards, comprising: forming a randomly determined set symbol on each card in the set of cards with a first card-handling device; transmitting with a data transmission device of the first card-handling device a signal representing the randomly determined set symbol to a second card-handling device; and detecting with the second card-handling device whether each card of the set of cards includes a set symbol matching the randomly determined set symbol.

Embodiment 11

The method of Embodiment 10, further comprising, when a card does not include a set symbol matching the randomly determined set symbol, providing a signal indicating a card does not belong to the set.

Embodiment 12

The method of Embodiment 10 or 11, further comprising selecting the first card-handling device from the group consisting of a shuffler and a deck verification device.

Embodiment 13

The method of any one of Embodiments 10 through 12, further comprising randomly determining the set symbol to be formed on each card with a random number generator of the first card-handling device.

Embodiment 14

The method of any one of Embodiments 10 through 13, further comprising receiving with a data reception device of the second card-handling device a signal indicating the randomly determined set symbol.

Embodiment 15

The method of any one of Embodiments 10 through 14, wherein detecting with the second card-handling device whether each card therein includes a set symbol matching the randomly determined set symbol comprises comparing a detected symbol of each card with the randomly determined set symbol.

Embodiment 16

The method of any one of Embodiments 10 through 15, wherein providing a signal indicating a card does not belong to the particular set of cards comprises one or more of providing an audible alarm, providing a visual alert, and causing the second card-handling device to preclude removal of cards therefrom.

Embodiment 17

An automatic card shuffler, comprising: a card infeed tray; a card-shuffling mechanism; a card output tray; a processor programmed to randomly select a set symbol to form on each card in a set of cards; and a card-marking system for forming the randomly selected set symbol on each card received in the card infeed tray prior to delivery of each card to the card output tray.

Embodiment 18

The automatic card shuffler of Embodiment 17, further comprising a card-reading device for reading set symbols on cards delivered to the card output tray, wherein the card-reading device is in information communication with the processor.

Embodiment 19

The automatic card shuffler of Embodiment 18, wherein the processor is configured to generate a signal indicating a delivered card does not include a set symbol matching the randomly selected set symbol.

Embodiment 20

The automatic card shuffler of any one of Embodiments 17 through 19, wherein the card-marking system is positioned in the automatic card shuffler to form the randomly selected set symbol on each card prior to each card reaching the card-shuffling mechanism.

Embodiment 21

The automatic card shuffler of any one of Embodiments 17 through 20, wherein the card-marking system is positioned in the automatic card shuffler to form the randomly selected set symbol on each card while each card is positioned in the card infeed tray.

Embodiment 22

The automatic card shuffler of any one of Embodiments 17 through 21, wherein the card-marking system is configured to form the randomly selected set symbol on each card by one of applying a visible ink to the card, applying an invisible ink to the card, removing material of the card, burning the card, embossing the card, and debossing the card.

Embodiment 23

The automatic card shuffler of any one of Embodiments 17 through 22, wherein the processor programmed to randomly select a set symbol to form on each card in a set of cards comprises the processor programmed to randomly select a set symbol selected from the group consisting of a random sequence of numbers, a random sequence of letters, a random sequence of special characters, a random bar code, a random dot matrix code, a random pictograph, a random sequence of foreign language symbols, and combinations thereof.

Embodiment 24

The automatic card shuffler of any one of Embodiments 17 through 23, wherein the card output tray is detachable from the card-shuffling mechanism and the card infeed tray.

Systems of the present disclosure may provide greater security as compared to card-handling devices that read a casino code, or manufacturer-applied markings. Cards with the same markings can be added to a show by casino personnel or players and those added cards may not be detected. By randomly selecting a card marking, applying the marking, transmitting a marking code to a second card-handling device, and then reading the randomly selected markings, an improved level of game security can be achieved. Even if the marked cards are stored before loading into a card shoe, casino table game security is increased because the card markings may be invisible to the human eye (either because the cards are marked with markings not perceptible in the visible light spectrum or because special equipment such as a magnifier or other decoder may be required to read the selected symbol). Thus, the present disclosure may provide additional barriers to a player or dealer desiring to insert one or more cards that are not part of the casino's set of cards, and/or such cards may be detected by the systems of the present disclosure.

While certain illustrative embodiments have been described in connection with the figures, those of ordinary skill in the art will recognize and appreciate that embodiments encompassed by the disclosure are not limited to those embodiments explicitly shown and described herein. Rather, many additions, deletions, and modifications to the embodiments described herein may be made without departing from the scope of embodiments encompassed by the disclosure, such as those hereinafter claimed, including their legal equivalents. In addition, features from one disclosed embodiment may be combined with features of another disclosed embodiment while still lying within the scope of the disclosure.

What is claimed is:

1. A system for handling and verifying sets of playing cards, the system comprising:

an automatic card shuffler, comprising:

a card-shuffling mechanism configured to shuffle a set of playing cards; and a printing device for applying a same set symbol to each card in the set of playing cards to uniquely identify the set of playing cards prior to removal of the set of playing cards from the automatic card shuffler;

a card output tray comprising:

a receptacle for receiving playing cards from the set of playing cards in the automatic card shuffler; and a set symbol reader for reading each card of the set of playing cards for a presence and identity of a set symbol; and at least one processor programmed to randomly select the set symbol for application to each card in the set of playing cards by the printing device and configured to verify, using data from the set symbol reader, that each playing card of the set of playing cards includes a set symbol matching the randomly selected set symbol.

2. The system of claim 1, wherein the at least one processor comprises a first processor programmed to randomly select the set symbol and a second, different processor configured to verify, using data from the set symbol reader, that each playing card of the set of playing cards includes a set symbol matching the randomly selected set symbol.

3. The system of claim 2, wherein the first processor is housed within the automatic card shuffler and the second processor is housed within the card output tray.

4. The system of claim 1, wherein the at least one processor consists of a single processor.

5. The system of claim 1, wherein the automatic card shuffler and the card output tray are positioned immediately adjacent to each other, the card output tray configured to automatically receive cards directly from the automatic card shuffler.

6. The system of claim 1, wherein the card output tray comprises a card-dealing shoe.

7. The system of claim 6, wherein the card-dealing shoe is located remote from the card-shuffling mechanism.

8. The system of claim 6, wherein the at least one processor comprises a first processor in the card-shuffling mechanism and a second processor in the card-dealing shoe.

9. A method of verifying that playing cards to be removed from a card-handling device belong to a particular set of playing cards, the method comprising:

inserting the particular set of playing cards into a first card-handling device comprising a printing device and a card-moving mechanism;

randomly determining a set symbol to be formed on each card in the particular set of playing cards with at least one processor;

forming the same randomly determined set symbol on each card in the particular set of playing cards with the printing device of the first card-handling device to uniquely identify the set of playing cards;

moving the particular set of playing cards from the first card-handling device to a second card-handling device;

detecting with a card reader of the second card-handling device the presence and identity of a set symbol on each card therein; and verifying, with the at least one processor and using data from the card reader of the second card-handling device, whether each card in the second card-handling device includes a set symbol matching the randomly determined set symbol.

10. The method of claim 9, further comprising, when a card in the second card-handling device does not include a set symbol matching the randomly determined set symbol, providing an indicator that the card does not belong to the particular set of playing cards.

11. The method of claim 10, wherein providing an indicator comprises providing an audible alarm or a visual alert at the second card-handling device.

12. The method of claim 10, wherein providing an indicator comprises causing the second card-handling device to preclude removal of cards therefrom.

13. The method of claim 9, wherein randomly determining a set symbol to be formed on each card in the particular set of playing cards with at least one processor comprises randomly determining the set symbol with a first processor, and wherein verifying, with the at least one processor, whether each card in the second card-handling device includes a set symbol matching the randomly determined set symbol comprises verifying, with a second processor, whether each card in the second card-handling device includes a set symbol matching the randomly determined set symbol.

14. The method of claim 9, wherein the at least one processor consists of a single processor.

15. An automatic card shuffler, comprising:

a card infeed tray configured to receive a set of playing cards to be shuffled;

a card-shuffling mechanism configured to receive and randomize the order of cards from the set of playing cards in the card infeed tray;

a card output tray configured to receive playing cards from the card-shuffling mechanism;

at least one processor programmed to randomly select a set symbol to form on each card in the set of playing cards; and a card-marking system for forming, prior to delivery of each card to the card output tray, the same randomly selected set symbol on each card received in the card infeed tray.

16. The automatic card shuffler of claim 15, further comprising a card-reading device for reading set symbols on cards delivered to the card output tray, wherein the card-reading device is in information communication with the at least one processor.

17. The automatic card shuffler of claim 16, wherein the at least one processor is configured to generate a signal indicating a delivered card does not include a set symbol matching the randomly selected set symbol.

18. The automatic card shuffler of claim 16, wherein the at least one processor comprises a first processor programmed to randomly select the set symbol to form on each card in the set of playing cards and a second processor in information communication with the card-reading device and with the first processor, the second processor programmed to determine whether set symbols on cards delivered to the card output tray match the set symbol randomly selected by the first processor.

19. The automatic card shuffler of claim 15, further comprising a touch screen configured to receive user inputs for operation of the automatic card shuffler.

20. The automatic card shuffler of claim 19, wherein the at least one processor is programmed to cause a visual alert to be displayed on the touch screen when the at least one processor identifies a card that does not include the randomly selected set symbol.

* * * * *